US010593251B2

(12) United States Patent
Shigeta et al.

(10) Patent No.: US 10,593,251 B2
(45) Date of Patent: Mar. 17, 2020

(54) DISPLAY PANEL AND DRIVING METHOD OF DISPLAY PANEL

(71) Applicant: SAMSUNG ELECTRONICS CO., LTD., Suwon-si (KR)

(72) Inventors: Tetsuya Shigeta, Suwon-si (KR); Sang-young Park, Suwon-si (KR); Ho-seop Lee, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/952,782

(22) Filed: Apr. 13, 2018

(65) Prior Publication Data

US 2018/0301080 A1 Oct. 18, 2018

Related U.S. Application Data

(60) Provisional application No. 62/484,971, filed on Apr. 13, 2017.

(30) Foreign Application Priority Data

Mar. 19, 2018 (KR) ..... 10-2018-0031625

(51) Int. Cl.
*G09G 3/20* (2006.01)
*G09G 3/32* (2016.01)
(Continued)

(52) U.S. Cl.
CPC ..... *G09G 3/2018* (2013.01); *G09G 3/2014* (2013.01); *G09G 3/32* (2013.01);
(Continued)

(58) Field of Classification Search
CPC ..... G09G 3/2018; G09G 3/2014; G09G 3/32; G09G 3/3208; G09G 3/3258;
(Continued)

(56) References Cited

U.S. PATENT DOCUMENTS 7,277,072 B2 10/2007 Akimoto et al.
2002/0196213 A1 12/2002 Akimoto et al.
(Continued)

FOREIGN PATENT DOCUMENTS

JP 2007-133043 A 5/2007
JP 2007-524118 A 8/2007
(Continued)

OTHER PUBLICATIONS

Communication dated Jul. 9, 2018, issued by the European Patent Office in counterpart European Application No. 18167108.2.
(Continued)

*Primary Examiner* — Robert J Michaud
(74) *Attorney, Agent, or Firm* — Sughrue Mion, PLLC

(57) ABSTRACT

A display panel including a plurality of pixel circuits is provided. Each of the plurality of pixel circuits includes a light emitting unit including a light emitting element; a control circuit configured to control a light emitting duration of the light emitting element based on an input end voltage; a first switching element connected between an input end and an output end of the control circuit; and a signal input unit including a second switching element and configured to transmit an input signal to the input end of the control circuit. The first switching elements of each of the plurality of pixel circuits are configured to simultaneously turn on or off.

15 Claims, 26 Drawing Sheets

(51) Int. Cl.
*G09G 3/3208* (2016.01)
*G09G 3/3258* (2016.01)

(52) U.S. Cl.
CPC ..... *G09G 3/3208* (2013.01); *G09G 3/3258* (2013.01); *G09G 2300/0819* (2013.01); *G09G 2310/0259* (2013.01); *G09G 2310/066* (2013.01); *G09G 2320/0233* (2013.01)

(58) Field of Classification Search
CPC ... G09G 2300/0819; G09G 2310/0259; G09G 2310/066; G09G 2320/0233
See application file for complete search history.

(56) References Cited

U.S. PATENT DOCUMENTS

2003/0063081 A1 4/2003 Kimura et al.
2004/0217925 A1 11/2004 Chung et al.
2005/0156832 A1* 7/2005 Ono ..... G09G 3/3258 345/76
2006/0132053 A1 6/2006 Cho et al.
2007/0222732 A1* 9/2007 Kageyama ..... G09G 3/3233 345/94
2009/0015521 A1 1/2009 Fish
2009/0167649 A1 7/2009 Ishizuka
2010/0277401 A1 11/2010 Takahara et al.
2012/0313923 A1 12/2012 Minami et al.
2014/0218414 A1 8/2014 Kikuchi et al.

FOREIGN PATENT DOCUMENTS

KR 10-0599497 B1 7/2006
KR 100914929 B1 9/2009
KR 10-2017-0038985 A 4/2017

OTHER PUBLICATIONS

International Search Report (PCT/ISA/210) dated Aug. 21, 2018 issued by the International Searching Authority in International Application No. PCT/KR2018/004327.
Written Opinion (PCT/ISA/237) dated Aug. 21, 2018 issued by the International Searching Authority in International Application No. PCT/KR2018/004327.

* cited by examiner

DISPLAY PANEL AND DRIVING METHOD OF DISPLAY PANEL

CROSS-REFERENCE TO RELATED APPLICATIONS

This application is based on and claims priority under 35 U.S.C. § 119 to Korean Patent Application No. 10-2018-0031625 filed on Mar. 19, 2018 in the Korean Intellectual Property Office, and U.S. Provisional Patent Application No. 62/484,971, filed on Apr. 13, 2017 in the United States Patent and Trademark Office, the disclosures of which are incorporated herein by reference in its entirety.

BACKGROUND

Field

The disclosure relates to a display panel and a driving method of the display panel and, and more particularly, to a display panel driven by an analog PWM (Pulse Width Modulation) method and a driving method of the display panel.

Description of the Related Art

A PWM (Pulse Width Modulation) method is widely used as a driving method of an LED (Light Emitting Diode) display panel for representing the gradation of a pixel.

The PWM method includes a digital PWM method and an analog PWM method. In the case of the digital PWM method, there are problems in that since a TFT (Thin Film Transistor) of a pixel is driven in a linear region, a brightness deviation largely occurs in accordance with a forward voltage (Vf) deviation of an LED and since gradation is represented by a sub-field method, there is a limitation in the number of gradations that may be represented and a false contour occurs.

On the other hand, the analog PWM method may drive the TFT in a saturation region of the TFT, and control the driving time of a light emitting element by using a sweep waveform such as a triangular wave or the like, and thus the analog PWM method is more useful than the LED driving method.

However, in the case of the analog PWM method, brightness uniformity may be problematic due to a deviation of a threshold voltage (Vth) or a mobility deviation (μ) between TFTs (Thin Film Transistors) of each pixel of an LED display panel. Therefore, it is necessary to correct deviation between TFTs.

In the analog PWM method, when displaying one image frame, a plurality of pixel circuits constituting a display panel are sequentially scanned line by line, a gradation data voltage is set in each line, and then a sweep voltage is collectively applied to all the pixel circuits to simultaneously drive the LEDs of the respective pixel circuits.

At this time, in the conventional analog PWM method, the deviation between the TFTs is corrected together when each line is scanned. A certain amount of time is required to correct the deviation, and the more time is spent to correct the deviation, the better the brightness uniformity is improved. However, since the time used to display one frame is constant (e.g., 1/60 second for 60 Hz, and 1/120 second for 120 Hz), when the scan time of a line is increased in order to increase a deviation correction effect, an LED emitting duration is reduced, resulting in a problem that the light emitting efficiency is lowered. Also, when the light emitting duration is increased in order to increase the LED emitting efficiency, an effect of correcting the deviation between TFTs is lowered, resulting in a problem that brightness uniformity deteriorates.

As described above, there is a trade-off relationship between the improvement of the brightness uniformity owing to the improvement of the deviation correction effect and the improvement of the light emitting efficiency in accordance with the increase of the light emitting duration, resulting in a problem that both may not be improved according to the conventional PWM method.

SUMMARY

Embodiments of the disclosure overcome the above disadvantages and other disadvantages not described above.

The disclosure provides a display panel and a driving method of the display panel capable of increasing brightness uniformity and light emitting efficiency simultaneously.

According to an aspect of the disclosure, a display panel includes a plurality of pixel circuits, wherein each of the plurality of pixel circuits includes a light emitting unit including a light emitting element; a control circuit configured to control a light emitting duration of the light emitting element based on an input end voltage; a first switching element connected between an input end and an output end of the control circuit; and a signal input unit including a second switching element and configured to transmit an input signal to the input end of the control circuit, wherein the first switching elements of each of the plurality of pixel circuits are simultaneously turned on/off, wherein the input end voltage of the control circuit is set to a first voltage based on a reference signal input through the second switching element while the first and second switching elements are turned on and, after being set to the first voltage, when the first and second switching elements are turned off, is changed from the first voltage to a second voltage based on the reference signal, and wherein, after the input end voltage of the control circuit is changed to the second voltage, when a gradation data signal and a sweep signal are input through the signal input unit, the control circuit is configured to control the light emitting duration of the light emitting element based on the input end voltage changed according to the gradation data signal and the sweep signal.

The signal input unit may include a first capacitor having one end connected to the input end of the control circuit and another end connected to one end of the second switching element; and a second capacitor having one end connected to one end or the other end of the first capacitor and another end receiving the sweep signal, wherein the signal input unit is configured to transfer the reference signal and the gradation data signal input through the other end of the second switching element to the input end of the control circuit through the first capacitor while the second switching element is turned on.

The input end voltage of the control circuit may be set to a third voltage based on the gradation data signal input through the second switching element while the second switching element is turned on again after being changed to the second voltage, and is changed according to the sweep signal input through the second capacitor after being set to the third voltage, and wherein the control circuit is configured to control the light emitting duration of the light emitting element by controlling on/off of the light emitting element based on the input end voltage changed according to the sweep signal.

Magnitude of the reference signal and the gradation data signal when the one end of the second capacitor is connected to the other end of the first capacitor may be smaller than that when the one end of the second capacitor is connected to the one end of the first capacitor.

Each of the second switching elements of the plurality of pixel circuits may be turned on together while the first switching element is turned on, transfer the reference signal to the input end of the control circuit of each of the plurality of pixel circuits, sequentially turned on after the input end voltage of the control circuit is changed to the second voltage, and transfer a gradation data signal for each of the plurality of pixel circuits to the input end of the control circuit of each of the plurality of pixel circuits.

The control circuit may be any one of a PMOSFET (P-channel metal oxide semiconductor field effect transistor), an NMOSFET (N-channel Metal Oxide Semiconductor Field Effect Transistor), and a CMOSFET (Complementary Metal Oxide Semiconductor Field Effect Transistor) inverter, and wherein the first and second switching elements are PMOSFETs or NMOSFETs.

When the control circuit is the PMOSFET or the NMOSFET, a gate end of the PMOSFET or the NMOSFET may become the input end of the control circuit, and a drain end of the PMOSFET or the NMOSFET may become an output end of the control circuit, and wherein when the control circuit is the CMOSFET inverter, an input end of the CMOSFET inverter becomes the input end of the control circuit, and the output end of the CMOSFET inverter becomes the output end of the control circuit.

When the control circuit is the PMOSFET, the drain end of the PMOSFET may be connected to an anode end of the light emitting element having cathode end connected to a ground end, and a source end of the PMOSFET is connected to a driving voltage end, and wherein the PMOSFET is turned on/off according to a gate end voltage of the PMOSFET which is changed based on the gradation data signal and the sweep signal to control the light emitting duration of the light emitting element.

When the control circuit is the NMOSFET, the drain end of the NMOSFET may be connected to a cathode end of the light emitting element having anode end connected to a driving voltage end, and a source end of the NMOSFET is connected to a ground end, and wherein the NMOSFET is turned on/off according to a gate end voltage of the NMOSFET which is changed based on the gradation data signal and the sweep signal to control the light emitting time of the light emitting element.

When the control circuit is the CMOSFET inverter, an output end of the CMOSFET inverter may be connected to an anode end of the light emitting element having cathode end connected to a ground end, and wherein the CPMOSFET inverter is turned on/off according to an input end voltage of an inverter of the CMOSFET which is changed based on the gradation data signal and the sweep signal to control the light emitting duration of the light emitting element.

The light emitting unit may include a current source configured to supply a driving current to the light emitting element, and a third switching element connected between the current source and the light emitting element, and wherein the control circuit is configured to control the light emitting duration of the light emitting element by controlling on/off of the third switching element according to the input end voltage which is changed based on the gradation data signal and the sweep signal.

The light emitting unit may include a current source configured to supply a driving current to the light emitting element, and wherein the control circuit is configured to control the light emitting duration of the light emitting element by controlling a gate end voltage of a driving transistor included in the current source according to the input end voltage which is changed based on the gradation data signal and the sweep signal.

The light emitting unit may include a driving transistor and a current source configured to supply a driving current having a different amplitude to the light emitting element according to a magnitude of a voltage applied to a gate end of the driving transistor, and wherein the current source includes an amplitude setting circuit configured to apply voltages of different magnitudes to the gate end of the driving transistor.

The light emitting unit may be a light emitting diode (LED) or an organic light emitting diode (OLED).

According to another aspect of the disclosure, a driving method of a display panel including a plurality of pixel circuits, wherein each of the plurality of pixel circuits includes a light emitting unit including a light emitting element; a control circuit configured to control a light emitting duration of the light emitting element based on an input end voltage; a first switching element connected between an input end and an output end of the control circuit; and a signal input unit including a second switching element and configured to transmit an input signal to the input end of the control circuit, the driving method includes: setting an input end voltage of the control circuit to a first voltage based on a reference signal input through the second switching element while turning on the first and second switching elements; after setting the input end voltage of the control circuit to the first voltage, changing the input end voltage of the control circuit from the first voltage to a second voltage based on the reference signal by turning off the first and second switching elements; and after changing the input end voltage of the control circuit to the second voltage, when a gradation data signal and a sweep signal are input through the signal input unit, controlling the light emitting duration of the light emitting element based on the input end voltage of the control circuit changed according to the gradation data signal and the sweep signal, wherein the first switching elements of each of the plurality of pixel circuits are turned on/off simultaneously.

According to another aspect of the disclosure, a display panel includes a plurality of pixel circuits, wherein each of the plurality of pixel circuits comprises: a light emitting unit comprising a light emitting element; a control circuit configured to control a light emitting duration of the light emitting element based on an input end voltage; a first switching element connected between an input end and an output end of the control circuit; and a signal input unit comprising a second switching element and configured to transmit an input signal to the input end of the control circuit, wherein the first switching elements of each of the plurality of pixel circuits are configured to simultaneously turn on or off, wherein the input end voltage of the control circuit is set to a first voltage based on a reference signal input through the second switching element while the first and second switching elements are turned on, and changed from the first voltage to a second voltage based on the reference signal when the first and second switching elements are turned off, and wherein, after the input end voltage is changed to the second voltage, the control circuit is further configured to control the light emitting duration based on the input end voltage changed according to a gradation data signal and a sweep signal input through the signal input unit.

According to yet another aspect of the disclosure, a driving method of a display panel including a plurality of pixel circuits, in which each of the plurality of pixel circuits comprises: a light emitting unit comprising a light emitting element; a control circuit configured to control a light emitting duration of the light emitting element based on an input end voltage; a first switching element connected between an input end and an output end of the control circuit; and a signal input unit comprising a second switching element and configured to transmit an input signal to the input end of the control circuit, the driving method comprising: setting an input end voltage of the control circuit to a first voltage based on a reference signal input through the second switching element while turning on the first and second switching elements; changing the input end voltage of the control circuit from the first voltage to a second voltage based on the reference signal by turning off the first and second switching elements; and after changing the input end voltage to the second voltage, controlling the light emitting duration based on the input end voltage changed according to a gradation data signal and a sweep signal input through the signal input unit, wherein the first switching elements of each of the plurality of pixel circuits are configured to simultaneously turn on or off.

As described above, according to various embodiments of the disclosure, the brightness uniformity and the light emitting efficiency of the display panel may be simultaneously improved.

BRIEF DESCRIPTION OF THE DRAWING

The above and/or other aspects of the disclosure will be more apparent by describing certain embodiments of the disclosure with reference to the accompanying drawings, in which.

DETAILED DESCRIPTION

In the description of the disclosure, a detailed description of known related art will be omitted if it is determined that the gist of the disclosure may be unnecessarily obscured. Further, redundant description of the same constitution will be omitted.

The suffix "unit" for the constituent elements used in the following description is given or mixed only in consideration of easy drafting of the specification, and does not have its own meaning or function to distinguish from each other.

The terms used in the disclosure are used to illustrate the embodiments and are not intended to limit and/or restrict the disclosure. The singular forms "a," "an," and "the" include plural expressions unless the context clearly dictates otherwise.

In the specification, terms such as "including" or "having" are used to designate the presence of stated features, integers, steps, operations, elements, components, or combinations thereof, but do not preclude the presence or addition of one or more other features, integers, steps, operations, components, parts, or combinations thereof.

The expressions "1st,", "2nd,", "first,", "second," etc. used in the disclosure may be used to express various components irrespective of order and/or importance, but are used to distinguish one component from other components and does not limit the components.

When it is mentioned that a component (e.g., a first component) is "(operatively or communicatively) coupled with/to" or "connected to" another component (e.g., a second component), it is to be understood that the one component may be directly coupled with/to the other component or may be coupled with/to the other component via another component (e.g., a third component). On the other hand, when it is mentioned that a component (e.g., a first component) is "directly coupled with/to" or "directly connected to" another element (e.g., a second component), it is to be understood that there is no other component (e.g., a third component) between one component and the other component.

Various embodiments of the disclosure will now be described in detail with reference to the accompanying drawings.

An analog PWM method according to the prior art and problems caused thereby will be briefly described with reference to FIGS. 1A through 2B, and various embodiments of the disclosure will be described with reference to FIG. 3 below.

The analog PWM method is also referred to as a CI (Clumped Inverter) method. In the CI method, an input end and an output end of an inverter are short-circuited in order to correct a deviation between TFTs of a display panel, the input end voltage of the inverter is set to a threshold voltage, a gradation data voltage is set to a capacitor connected to the input end of the inverter, and then a sweep waveform varying over time is input, thereby controlling a driving time width of a light emitting element.

Figure 1A:
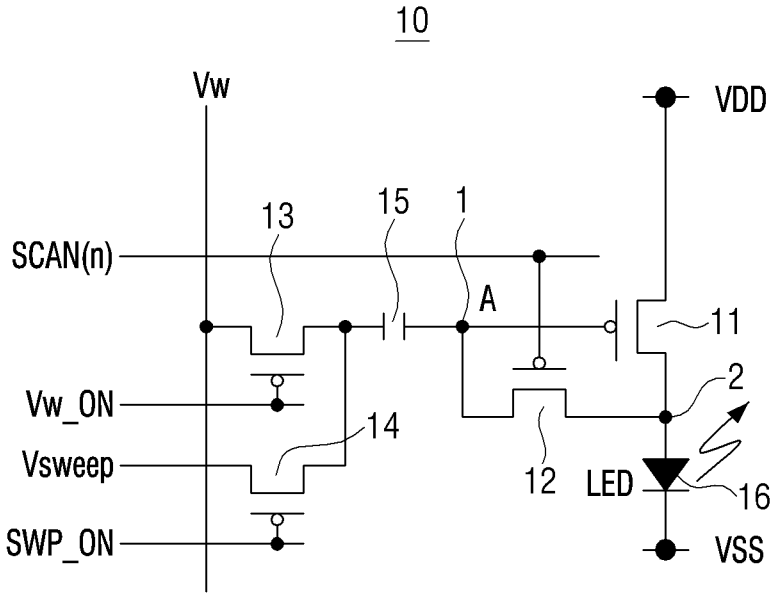
FIGS. 1A through 2B are diagrams for explaining pixel circuits and an analog PWM method according to the prior art.
Figure 1A:
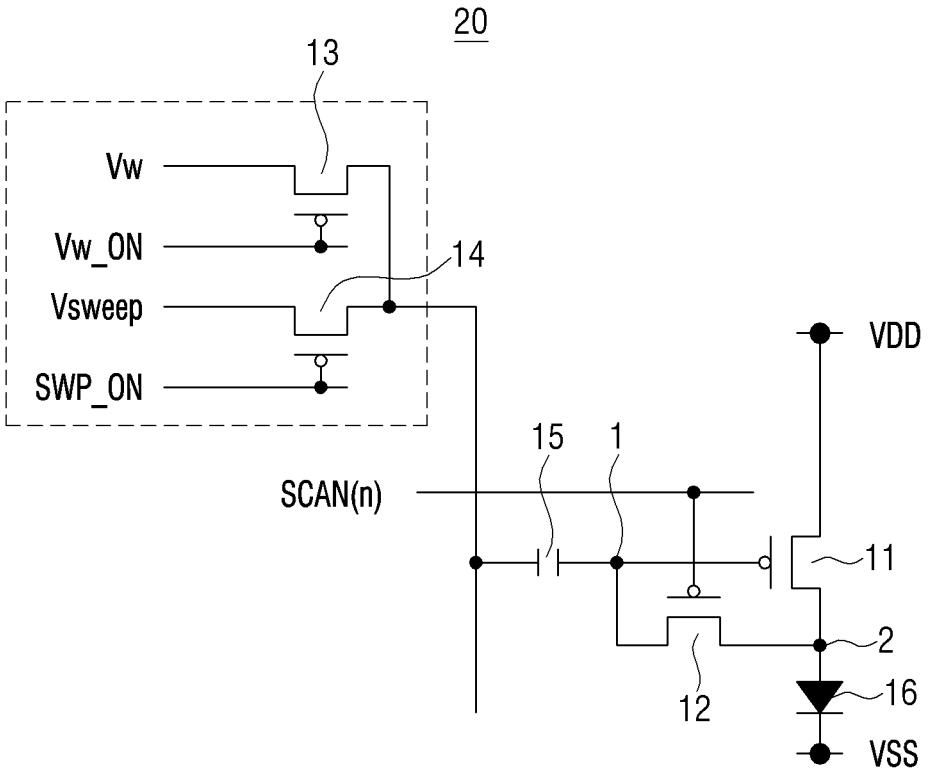

FIG. 1A is an diagram of a pixel circuit constituting a pixel of a display panel according to the prior art. A pixel circuit 10 of FIG. 1A shows a circuit configuration that implements a switching transistor 13 and a switching transistor 14 in the pixel circuit 10 such that switching is performed between a gradation data signal Vw and a sweep signal Vsweep inside the pixel circuit 10. A pixel circuit 20 of FIG. 1A shows a circuit configuration that implements the switching transistor 13 and the switching transistor 14 outside the pixel circuit 20 such that switching is performed between the gradation data signal Vw and the sweep signal Vsweep outside the pixel circuit 20.

In the pixel circuits 10 and 20 of FIG. 1A, an inverter is implemented as a transistor 11, and a switching element for short-circuiting an input end 1 and an output end 2 of the inverter is implemented as a transistor 12. On the other hand, it may be seen that a capacitor 15 for setting a gradation data voltage is connected to the input end 1 of the inverter.

Figure 1B:
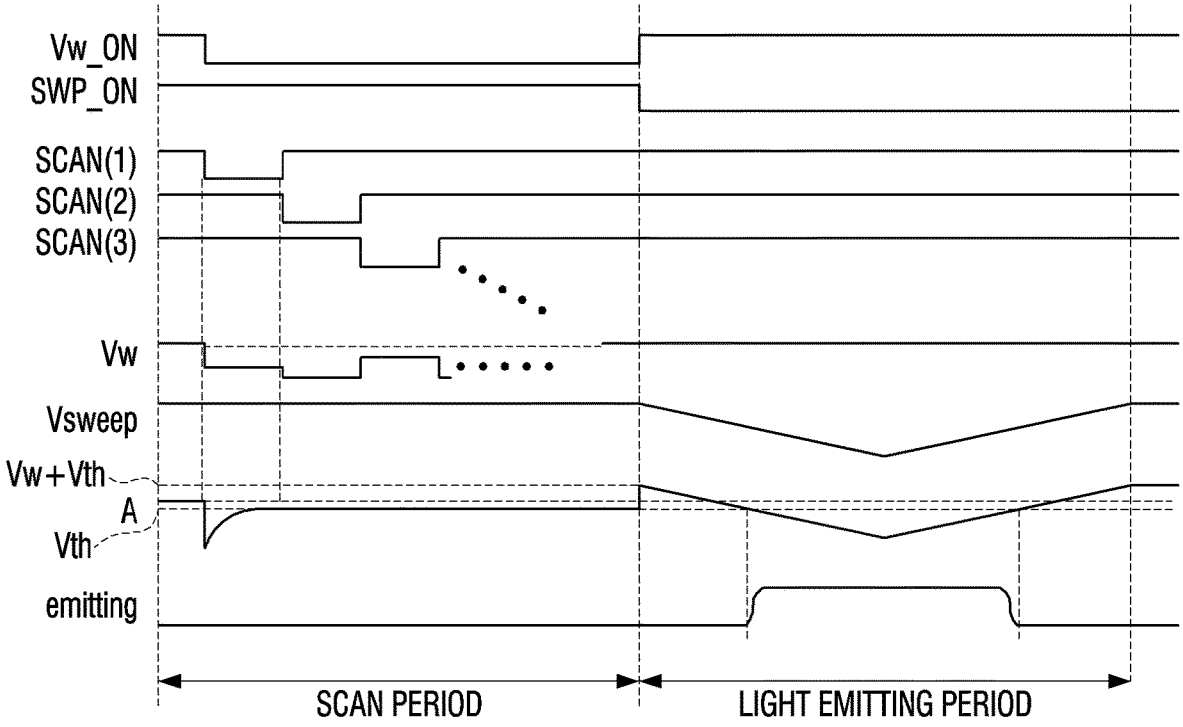

FIG. 1B is a timing diagram illustrating a voltage change of various signals and the input end 1 (point A) of the inverter when a display panel including the pixel circuits 10 and 20 of FIG. 1A is driven by the analog PWM method according to the prior art, that is, a CI method according to the prior art.

As shown in FIG. 1B, a pixel circuit driving time for displaying one frame of image in the CI method is divided into a scan period during which threshold voltage setting of the transistor 11 and gradation data voltage setting are performed and a light emitting period during which a light emitting element 16 emits during a period corresponding to the set gradation data voltage through a sweep signal.

At this time, in the conventional CI method, it may be seen that the threshold voltage (Vth) setting and the gradation data voltage (Vw) setting of the corresponding pixel are performed together during the scan period. That is, since the threshold voltage (Vth) setting and the gradation data voltage (Vw) setting are performed in the corresponding pixel circuit for each scan line, when the scan period is increased in order to increase the deviation correction effect described above, the light emitting period is reduced, resulting in a problem that the light emitting efficiency is lowered.

Figure 2A:
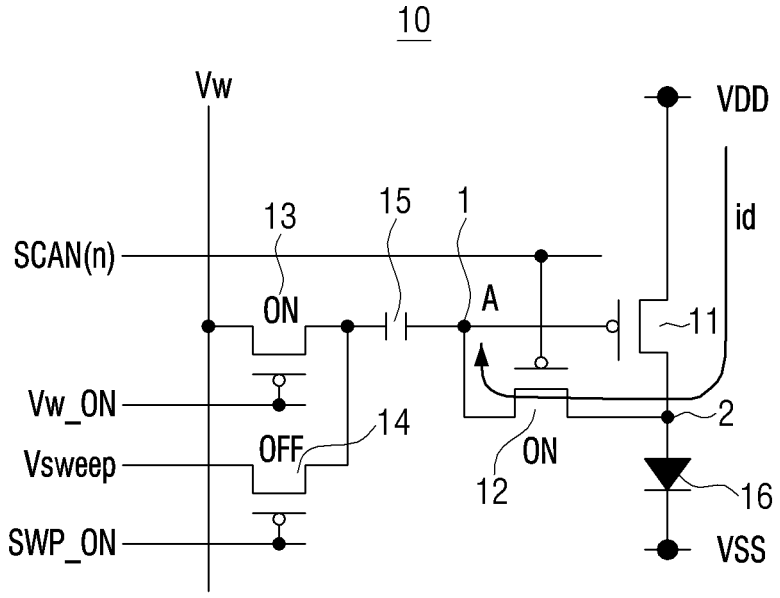
Figure 2B:
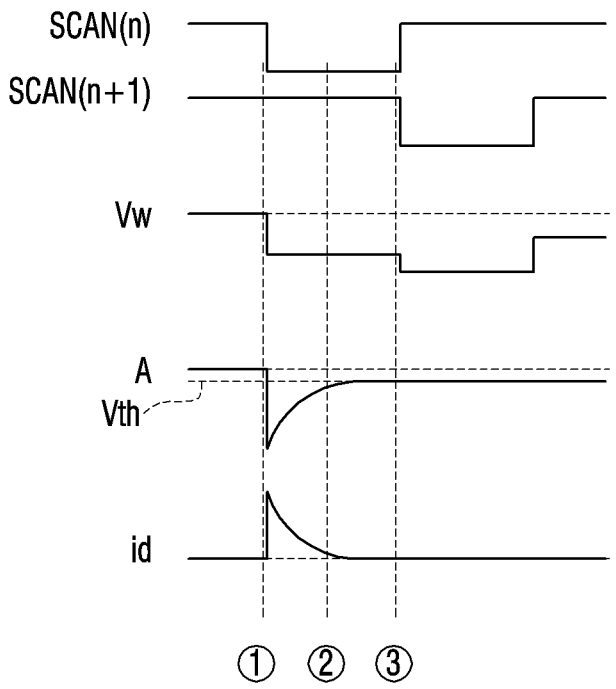

This will be described in more detail with reference to FIGS. 2A and 2B. FIG. 2A is a diagram of the pixel circuit 10 of FIG. 1A, and FIG. 2B is a timing diagram for explaining an operation of the pixel circuit 10 during a scan period.

As shown in FIG. 1B, since the switching transistor 13 is in an ON state during the scan period, the gradation data signal Vw is transferred to the point A 1 through the capacitor 15, and thus a potential of the point A 1 drops by a transferred gradation data voltage. At this time, when the transistor 12 is turned on according to a scan signal SCAN (n), the inverter, that is, the input end 1 and the output end 2 of the transistor 11 are short-circuited and a current id starts to flow, and thus, the potential of the point A 1 rises (①).

At this time, as a voltage between a gate and a source (point A-VDD) of the transistor 11 becomes closer to the threshold voltage Vth of the transistor 11, the current id decreases (②), and the voltage between the gate and the source (the point A to VDD) of the transistor 11 gradually becomes closer to the threshold voltage Vth of the transistor 11 over time (③).

In order to correct a deviation between pixels of the display panel upon driving in the analog PWM method, it is necessary to set the voltage of the input end 1 of the transistor 11 to the threshold voltage Vth before setting the gradation data voltage. As described above, a certain amount of time is necessary to set the voltage of the input end 1 of the transistor 11 to the threshold voltage Vth (theoretically, an infinite time is necessary to reach Vth completely).

Therefore, when the scan period is increased in order to increase the deviation correction effect, the light emitting duration is reduced and the light emitting efficiency deteriorates. When the scan period is reduced and the light emitting duration is increased only by considering the light emitting efficiency, the deviation correction effect is reduced, resulting in a problem that brightness uniformity is lowered.

Figure 3:
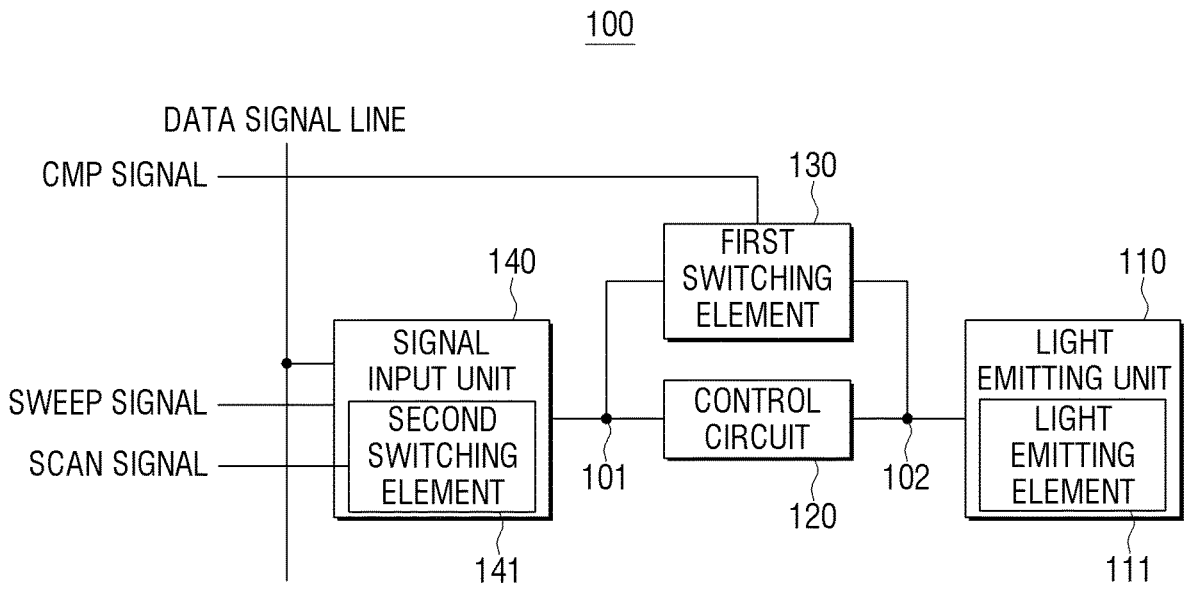
FIG. 3 is a block diagram of a pixel circuit included in a display panel according to an embodiment of the disclosure.
Figure 15:
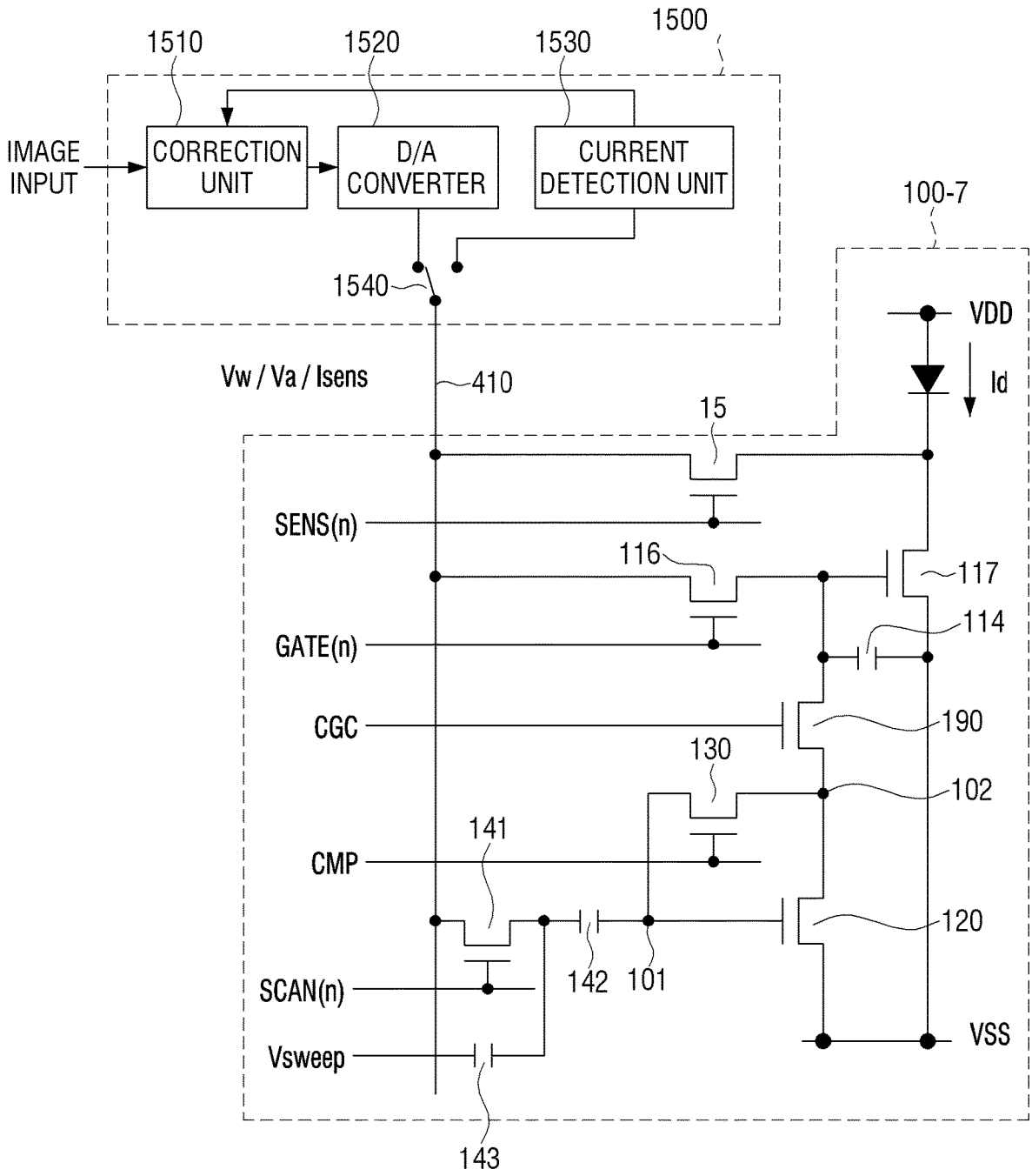

FIG. 3 is a block diagram of a pixel circuit according to an embodiment of the disclosure. Generally, a display device includes a display panel, and the display panel includes a plurality of pixels. At this time, each of the plurality of pixels included in the display panel may be implemented as a light emitting element for its operation and a peripheral circuit for driving the light emitting element. Referring to FIG. 15, in various embodiments of the disclosure, a pixel circuit means a circuit constituting each of a plurality of pixels of a display panel 500.

Referring to FIG. 3, the pixel circuit 100 includes a light emitting unit 110, a control circuit 120, a first switching element 130, and a signal input unit 140.

The light emitting unit 110 includes a light emitting element 111. The light emitting element 111 may represent different gradations according to the amplitude of a driving current supplied to the light emitting element 111 and a driving time. At this time, the light emitting element 111 may be an LED (Light Emitting Diode) or an OLED (Organic Light Emitting Diode), but the disclosure is not limited thereto.

The control circuit 120 controls a light emitting duration of the light emitting element 110. In particular, the control circuit 120 may control the light emitting duration of the light emitting element 110 based on a voltage of the input end 101. For example, the control circuit 120 may be implemented as any one of a PMOSFET (P-channel Metal Oxide Semiconductor Field Effect Transistor), an NMOSFET (N-channel Metal Oxide Semiconductor Field Effect Transistor), and a CMOSFET (Complementary Metal Oxide Semiconductor Field Effect Transistor), but the disclosure is not limited thereto.

The first switching element 130 is connected between the input end 101 and the output end 102 of the control circuit 120 and is turned on and off according to a control signal (CMP signal). In particular, when the first switching element 130 is turned on, the first switching element 130 short-circuits the input end 101 and the output end 102 of the control circuit 120.

The signal input unit 140 includes a second switching element 141 and transmits an input signal to the input end 101 of the control circuit 120. Specifically, the signal input unit 140 may transmit a signal applied through a data signal line to the input end 101 of the control circuit 120 when the second switching element 141 turned on according to a scan signal is turned on. The signal input unit 140 may also receive a sweep signal and may transmit the sweep signal to the input end 101 of the control circuit 120.

Meanwhile, the first switching element 130 and the second switching element 140 may be any one of a PMOSFET and an NMOSFET, but the disclosure is not limited thereto.

According to an embodiment of the disclosure, in the pixel circuit 100 as described above, the voltage of the input end 101 of the control circuit 120 may be set to a first voltage based on a reference signal input through the second switching element 141 when the first switching element 130 and the second switching element 141 are turned on, and, when the first switching element 130 and the second switching element 141 are turned off after being set to the first voltage, may be changed from the first voltage to a second voltage based on the reference signal.

Accordingly, when the voltage of the input end 101 of the control circuit 120 is changed to the second voltage and a gradation data signal and the sweep signal are input through the signal input unit 140, the control circuit 120 may control the light emitting duration of the light emitting element 111 based on the voltage of the input end 101 changed according to the gradation data signal and the sweep signal.

At this time, the first switching elements 130 of each of the plurality of pixel circuits constituting the display panel 500 are simultaneously turned on/off.

Unlike the conventional analog PWM method, the brightness uniformity and the light emitting efficiency of the display panel may be simultaneously improved through the configuration of the pixel circuit 100 as described above.

Figure 4A:
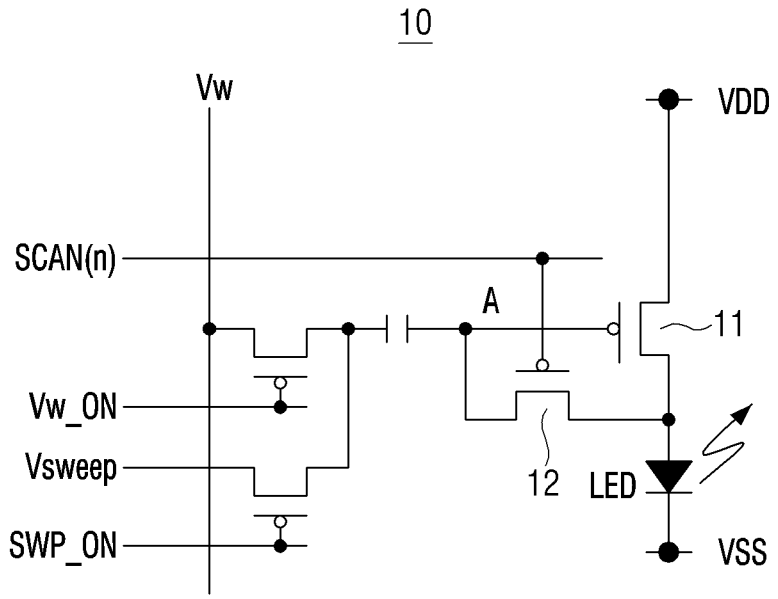
FIGS. 4A and 4B are diagrams for explaining differences in the configuration and operation between a pixel circuit according to an embodiment of the disclosure and a pixel circuit according to the prior art.
Figure 4A:
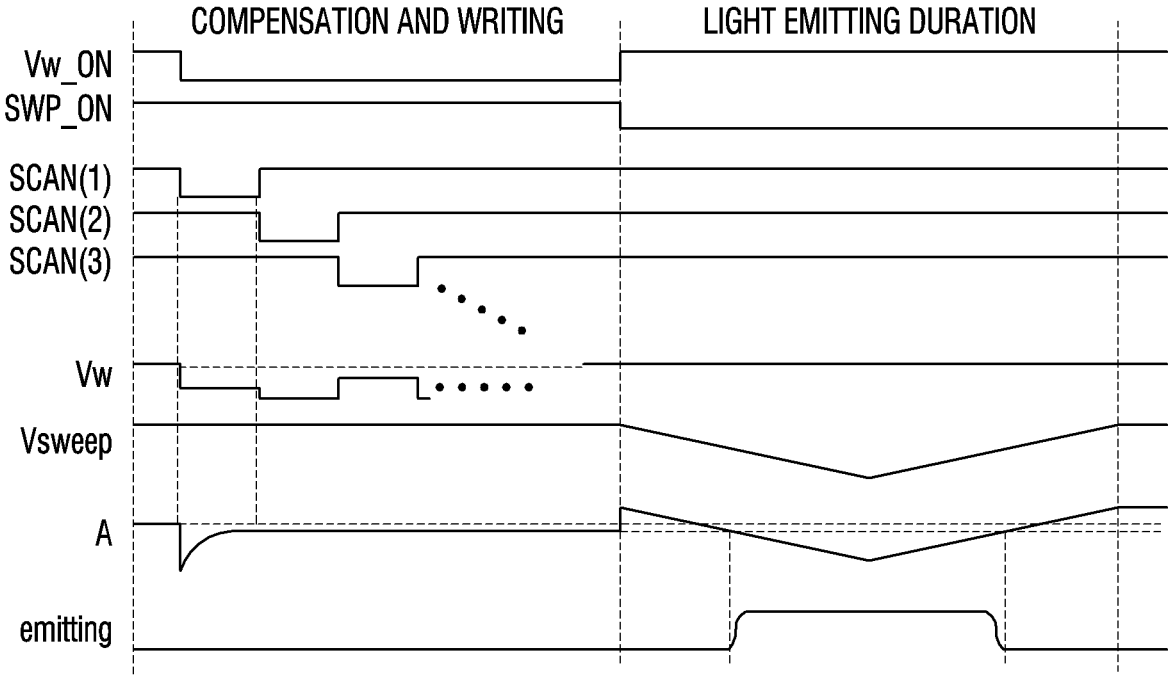

Differences in the configuration and operation between a pixel circuit according to an embodiment of the disclosure and a pixel circuit according to the prior art will be described in more detail with reference to FIGS. 4A and 4B. An upper view of FIG. 4A shows the conventional pixel circuit 10 of FIG. 1A, and a lower view shows the conventional timing diagram of FIG. 1B.

Figure 4B:
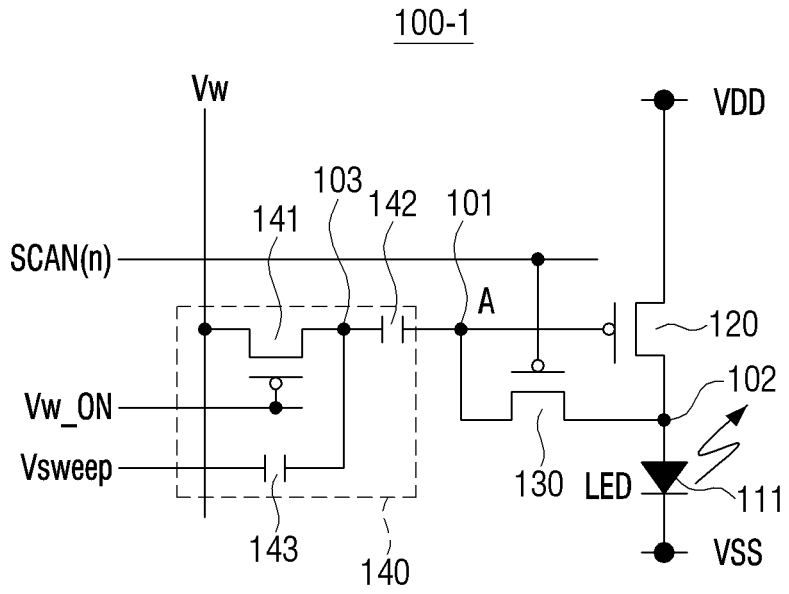
Figure 4B:
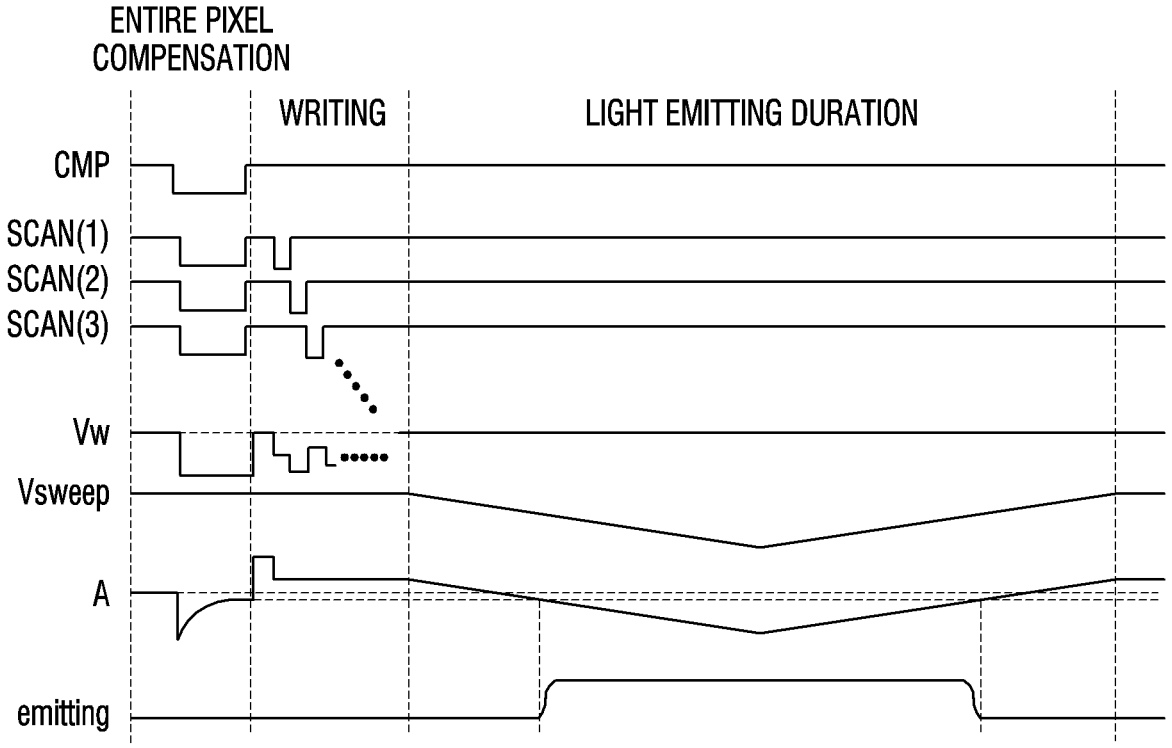

An upper view of FIG. 4B shows a pixel circuit 100-1 according to an embodiment of the disclosure, and a lower view of FIG. 4B is a timing diagram showing various signals and a voltage change of the input end 101 (point A) of an inverter when a display panel including pixel circuits having the same configuration as the pixel circuit 100-1 is driven by an analog PWM method according to an embodiment of the disclosure.

First, it may be seen that the configuration of the light emitting element 111, the control circuit 120, and the first switching element 130 is the same as that of the conventional pixel circuit 10 in the pixel circuit 100-1 shown in FIG. 4B. However, it may be seen that the configuration of the signal input unit 140 is different from that of the conventional pixel circuit 10 and various control signals CMP and SCAN(n) and a sweep signal are differently input from those of the conventional pixel circuit 10.

More specifically, the signal input unit 140 of the pixel circuit 100-1 according to an embodiment of the disclosure may include a first capacitor 142 having one end 101 connected to the input end 101 of the control circuit 120 and another end 103 connected to one end 103 of the second switching element 141 and a second capacitor 143 having one end 103 connected to the other end 103 of the first capacitor 142 and another end receiving the sweep signal.

Accordingly, the signal input unit 140 may transfer a reference signal and a gradation data signal input through the other end of the second switching element 141 to the input end 101 of the control circuit 120 through the first capacitor 142 while the second switching element 141 is turned on.

The pixel circuit 100-1 of FIG. 4B exemplifies that the control circuit 120, the first switching element 130, and the second switching element 141 are implemented as PMOSFETs, as will be described later, but the disclosure is not limited thereto.

Meanwhile, as shown in the lower timing diagram of FIG. 4A, in the case of the conventional analog PWM method, a plurality of pixel circuits constituting a display panel are sequentially scanned line by line during a scan period, and the deviation compensation of the pixel circuits (i.e. setting of the threshold voltage Vth of the corresponding pixel) and setting of the gradation data voltage Vw are performed for each scan line.

On the other hand, in the case of the analog PWM method according to an embodiment of the disclosure, as shown in the lower timing diagram of FIG. 4B, during the scan period, firstly, deviation compensations (setting of the threshold voltage Vth) of all the pixel circuits constituting the display panel are simultaneously performed, and then setting of the gradation data voltage Vw are performed for each scan line.

Therefore, according to an embodiment of the disclosure, a deviation compensation time of pixel circuits may be reduced compared to the conventional analog PWM method, and as a result, a light emitting duration may be sufficiently secured, and thus the brightness uniformity and the light emitting efficiency may be continuously improved.

Figure 5A:
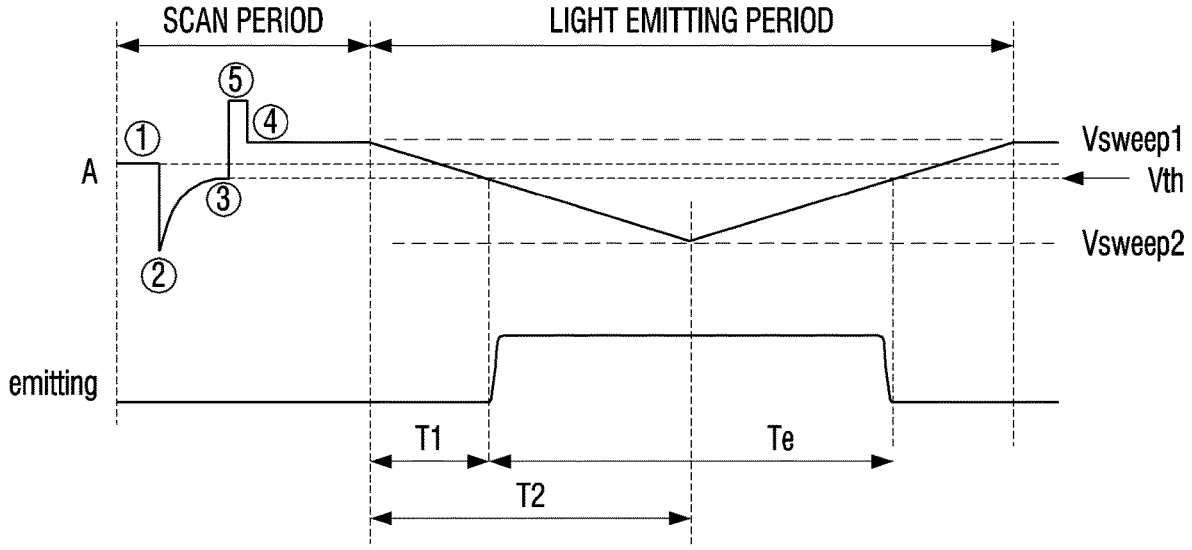
FIGS. 5A and 5B are diagrams for explaining a deviation compensation effect of a pixel circuit according to an embodiment of the disclosure.
Figure 5B:
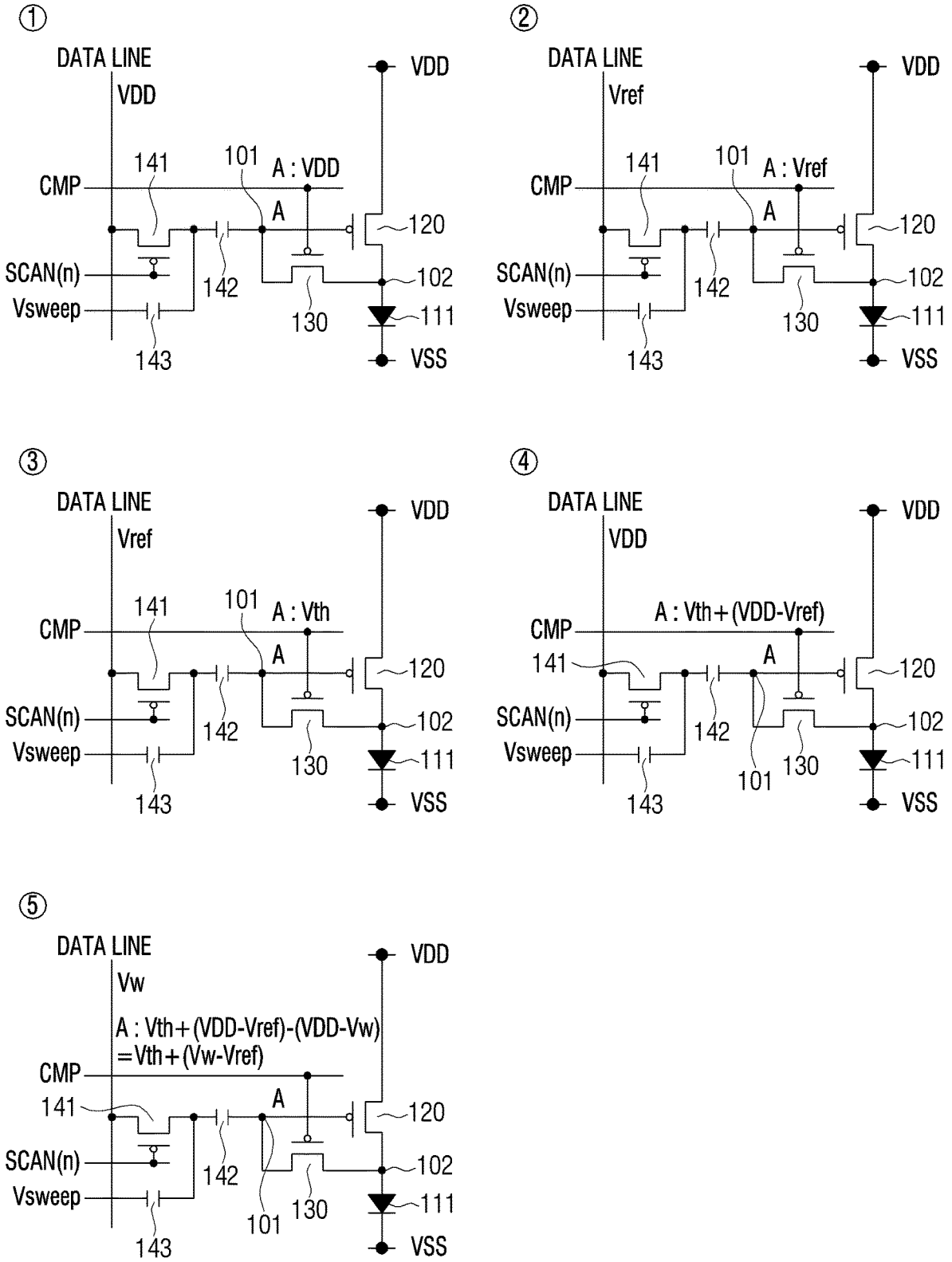

Hereinafter, a deviation compensation effect of the pixel circuit 100-1 according to an embodiment of the disclosure will be described with reference to FIGS. 5A and 5B. FIGS. 5A and 5B are a timing diagram and a circuit diagram respectively showing voltage changes of the input end 101 (point A) of the pixel circuit 100-1 during a scan period and a light emitting duration. ① through ⑤ of FIG. 5A correspond to circuits ① through ⑤ of FIG. 5B, respectively.

Firstly, as shown in ① of FIGS. 5A and 5B, the second switching element 141 is turned on according to the scan signal SCAN(n) in a state where a voltage of the point A is VDD, and thus as shown in ② of FIG. 5B, the reference voltage Vref is applied to the point A through a data line.

At this time, as shown in the lower timing diagram of FIG. 4B, according to an embodiment of the disclosure, the control signal CMP is applied to the first switching element 130 simultaneously with the scan signal SCAN(n) during the entire pixel compensation period, the voltage of the point A is not maintained at the reference voltage Vref but converges to the threshold voltage Vth of the control circuit 120 over time as shown in ③ of FIG. 5A and FIG. 5B. This is because the first switching element 130 is turned on according to the control signal CMP and thus the input end 101 and the output end 102 of the control circuit 120 are short-circuited.

Thereafter, when the second switching element 141 and the first switching element 130 are turned off according to the scan signal SCAN(n) and the control signal CMP, the voltage of the point A is changed from the threshold voltage (Vth) to Vth+(VDD−Vref) as shown in ④ of FIG. 5A and FIG. 5B. This is because the first switching element 130 is also turned off when the voltage of the point A is changed by (VDD−Vref) since the second switching element 141 is turned off, the input end 101 and the output end 102 of the control circuit 120 are no longer in a short-circuited state.

On the other hand, when the second switching element 141 is turned on again according to the scan signal SCAN(n) after the voltage of the point A becomes Vth+(VDD−Vref), the gradation data voltage Vw is inputted through the data line, and thus the voltage of the point A is set to Vth+(Vw−Vref) as shown in 5 FIG. 5A and FIG. 5B.

As described above, the voltage Vth+(Vw−Vref) set at the point A is maintained during the remaining scan period. When the sweep signal Vsweep is input through the capacitor 143 during a light emitting period and changes according to the input sweep signal by using the set voltage Vth+(Vw−Vref) as a starting point, the control circuit 120 controls the light emitting duration of the light emitting element 111 based on a voltage of the input end 101 (point A) which changes according to the sweep signal.

Specifically, the control circuit 120 controls on/off of the light emitting element 111 to control the light emitting duration. At this time, since the control circuit 120 is implemented as a PMOSFET, a gate end of the PMOSFET 120 becomes the input end 101 of the control circuit 120 and a drain end becomes the output end 102 of the control circuit 120. Meanwhile, since the pixel circuit 100-1 has a structure in which a source end of the PMOSFET 120 is connected to a driving voltage VDD end and a drain end is connected to an anode end of the light emitting element 111, when a voltage lower than the threshold voltage Vth of the PMOSFET 120 is applied between the gate end and the source end of the PMOSFET 120, the light emitting element 111 is turned on, and when a voltage exceeding the threshold voltage Vth is applied, the light emitting element 111 is turned off.

At this time, referring to FIG. 5A, the light emitting duration of the light emitting element 111 is calculated as shown in Equation 1 below.

$$T1 = \frac{Vth + (Vw - Vref) - Vth}{S} = \frac{Vw - Vref}{S} \quad \text{[Equation 1]}$$

$$T2 = \frac{Vsweep1 - Vsweep2}{S}$$

$$Te = (T2 - T1) * 2 = \frac{((Vsweep1 - Vsweep2) - (Vw - Vref))}{S} * 2$$

In Equation 1 above, Vth denotes the threshold voltage Vth of the control circuit 120, that is, a threshold voltage of the PMOSFET 120, Vref denotes a reference voltage, S denotes a slope of the sweep voltage Vsweep, Vsweep1 denotes a voltage set at the input end 101 of the control circuit 120 before the light emitting period starts, that is, an initial voltage of the input end 101 of the control circuit 120 when the light emitting period starts, Vsweep2 denotes a voltage at a middle point of the light emitting period, T1 denotes a time until the voltage of the input end 101 of the control circuit 120 changes according to the sweep signal Vsweep to initially reach the threshold voltage Vth of the control circuit 120, that is, the threshold voltage of the PMOSFET after the light emitting period starts, T2 is a middle time of a light emitting period, and Te denotes a light emitting duration of the light emitting element 111.

It may be seen from Te that the light emitting duration of the light emitting element 111 is determined irrespective of Vth in Equation 1 above. That is, the deviation between a plurality of pixel circuits constituting a display panel may be compensated through the pixel circuit 100-1 according to an embodiment of the disclosure.

Figure 6:
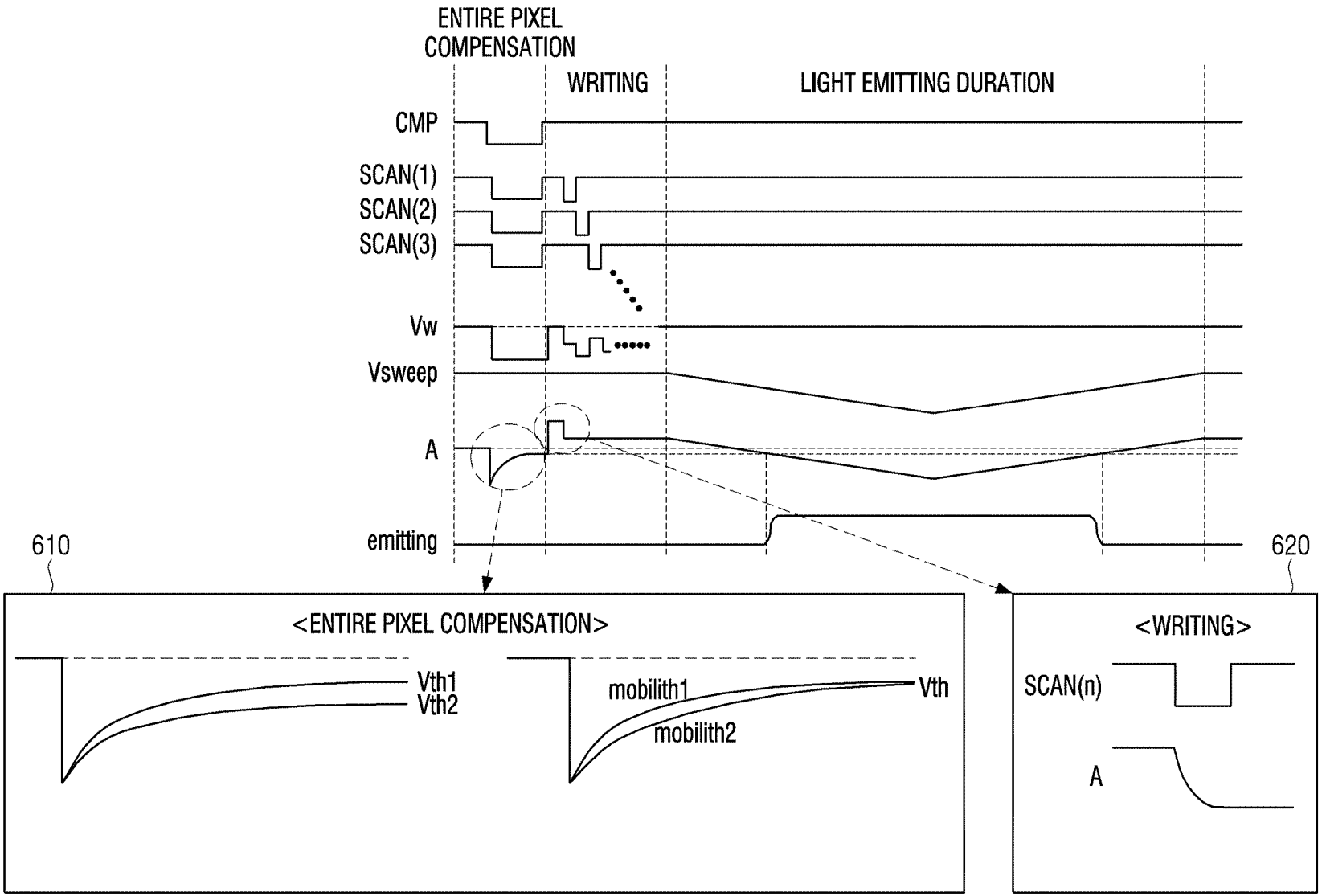
FIG. 6 is a diagram for explaining an effect through pixel circuits according to an embodiment of the disclosure in more detail.

FIG. 6 is a diagram for explaining an effect through the pixel circuits 100 and 100-1 according to an embodiment of the disclosure in more detail.

According to an embodiment of the disclosure, since a threshold voltage setting period (an entire pixel compensation period) for correcting the deviation between the pixel circuits 100 and 100-1 and a setting period of the gradation data voltage Vw determining a driving time of a light emitting element are distinguished, optimization is possible for each.

Further, even if the threshold voltage setting period is increased in order to increase the deviation compensation effect of the control circuit 120 (a transistor) included in the pixel circuits 100 and 100-1, since the deviation compensation is performed collectively on all the pixels, a deviation correction period is not greatly increased.

That is, as shown in reference numeral 610 of FIG. 6, a voltage of the point A approaches the threshold voltage Vth as a state where the first switching element 130 is turned on, that is, the deviation correction period (=the entire pixel compensation period) increases, and a potential difference due to a mobility difference is also reduced, and thus the correction effect is enhanced.

Therefore, it is necessary to appropriately increase the deviation correction time. As described above, since the deviation correction and the gradation data voltage setting are performed for each scan line according to the prior art as described above, there is a limit in increasing the deviation correction period in consideration of the light emitting efficiency, whereas according to an embodiment of the disclosure, since all the pixels are collectively corrected simultaneously, it is not a great problem even if the correction period is increased.

Also, since the time for setting the gradation data voltage is relatively short compared to the deviation correction period, according to an embodiment of the disclosure, the time (a scan period) for scanning the entire line may be shortened, thereby increasing the light emitting efficiency of the light emitting element.

In other words, as shown in reference numeral 620 of FIG. 6, a charging time of the gradation data voltage when the gradation data voltage is set is determined by capacitance of the first capacitor 142 or a parasitic capacitance component of the transistor 120. According to an embodiment of the disclosure, since all pixel deviation correction is performed first during the scan period, only the gradation data voltage setting is required. Therefore, the light emitting duration may be increased by reducing time for scanning.

In the above description, the pixel circuit 100-1 in the upper view of FIG. 4B is shown as an example of the pixel circuit 100, but an implementation example of the pixel circuit 100 is not limited thereto.

Figure 7:
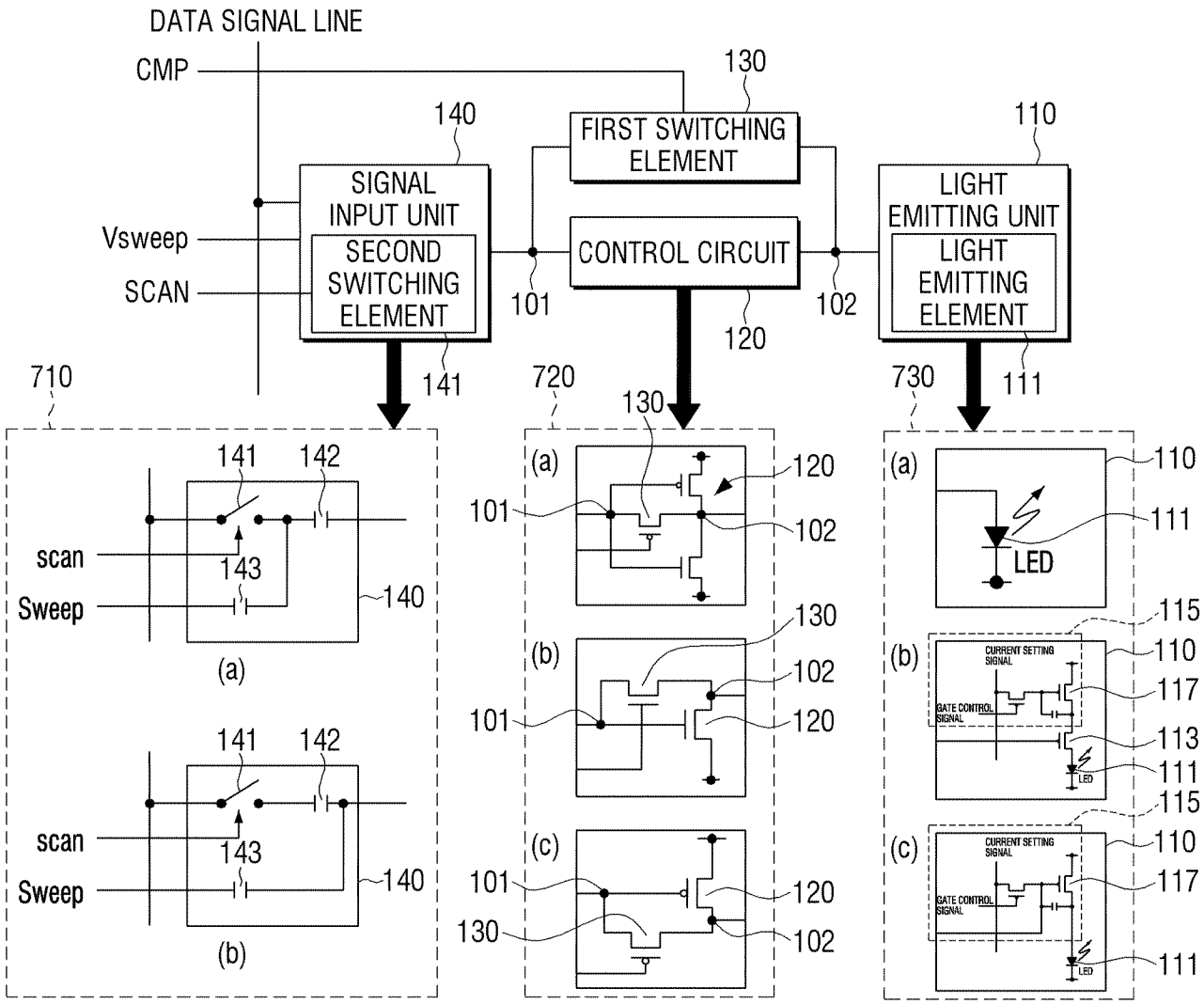
FIG. 7 illustrates an implementation example of a pixel circuit according to various embodiments of the disclosure.

FIG. 7 illustrates an implementation example of the pixel circuit 100 according to various embodiments of the disclosure. Specifically, reference numeral 710 denotes an implementation example of the signal input unit 140, reference numeral 720 denotes an implementation example of the first switching element 130 and the control circuit 120, and reference numeral 730 denotes the light emitting unit 110.

Referring to reference numeral 710, the signal input unit 140 may be implemented in two forms (a) and (b). The circuits (a) and (b) differ in that the second capacitor 143 is connected to which end of the first capacitor 142.

Referring to reference numeral 720, the first switching element 130 and the control circuit 120 may be realized in three forms (a), (b), and (c). In the case of the circuit (a), the control circuit 120 is implemented as a CMOS inverter, and the first switching element 130 is connected between the input end 101 and the output end 102 of the CMOS inverter.

On the other hand, in the case of the circuit (b), the control circuit 120 is implemented as an NMOSFET, in which the drain end 102 of the NMOSFET becomes an output end of the control circuit 120 and the gate end 101 becomes an input end of the control circuit 120.

In the case of the circuit (c), like the pixel circuit 100-1 of FIG. 4B described above, the control circuit 120 is implemented as a PMOSFET, in which the drain end 102 of the PMOSFET becomes the output end of the control circuit 120, and the gate end 101 becomes the input end of the control circuit 120.

Meanwhile, referring to reference numeral 730, the light emitting unit 110 may be implemented in three forms (a), (b), and (c). Each of the light emitting units 110 includes the light emitting element 111. In the case of (a), an example where the control circuit 120 directly controls on/off of the light emitting element 111 is illustrated.

(b) and (c) illustrate an embodiment in which the light emitting unit 110 includes a current source 115. In the case of (b), the light emitting unit 110 includes a switching element 113 between the current source 111 and the light emitting element 111, and the control circuit 120 controls on/off of the switching element 113, and thus on/off of the light emitting element 111 is controlled. At this time, the output end 102 of the control circuit 120 is connected to a gate end of the switching element 113.

On the other hand, in the case of (c), the control circuit 120 controls a gate end voltage of a driving transistor 117 included in the current source 115 to control on/off of the light emitting element 111. In this case, the output end 102 of the control circuit 120 is connected to a gate end of the driving transistor 117.

On the other hand, the pixel circuit 100 may be configured in various ways through a combination of circuits included in reference numerals 710 to 730.

Hereinafter, various embodiments of the disclosure will be described in more detail with reference to FIGS. 8 to 14B. At this time, redundant descriptions with the descriptions above will be omitted.

Figure 8:
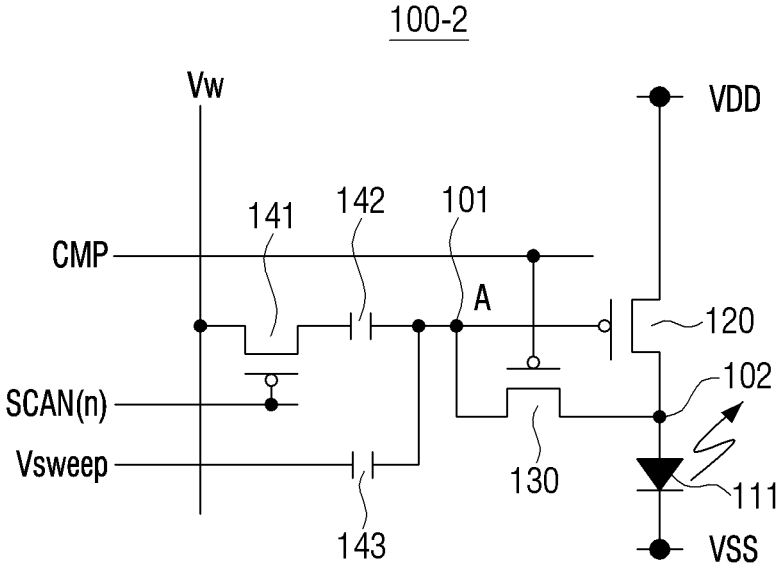
FIGS. 8 through 17B are specific example diagrams of a pixel circuit according to various embodiments of the disclosure.

FIG. 8 shows an embodiment in which a position to which the sweep voltage Vsweep is input is different from that of the pixel circuit 100-1 of FIG. 4B. Referring to FIG. 8, a pixel circuit 100-2 is different from the pixel circuit 100-1 of FIG. 4B in that a second capacitor 143 receiving the sweep signal Vsweep is directly connected to the input end 101 of the control unit 120.

In this case, since a voltage distribution is performed between the first capacitor 142 and the second capacitor 143, in order to apply a voltage of the same magnitude as that of the pixel circuit 100-1 of FIG. 4B to the input end 101 the control circuit 120 of the pixel circuit 100-2 of FIG. 8, the reference voltage Vref, the gradation data voltage Vw, and the sweep voltage Vsweep having a voltage higher than that in the example of FIG. 4B need to be applied to the pixel circuit 100-2.

For example, when the capacitances of the first capacitor 142 and the second capacitor 143 are the same, a voltage of the magnitude 2 times of that of the pixel circuit 100-1 of FIG. 4B needs to be applied to the pixel circuit 100-2 of FIG. 8 in order to operate the pixel circuit 100-2 of FIG. 8 in the same manner as the pixel circuit 100-1 of FIG. 4B.

Figure 9:
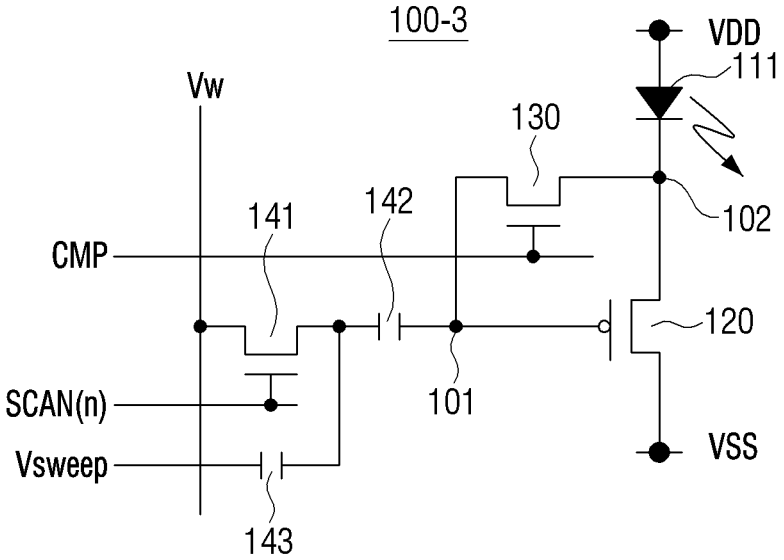

FIG. 9 shows an embodiment in which all the control circuit 120, the first switching element 130, and the second switching element 141 are implemented as NMOSFETs. Referring to FIG. 9, in a pixel circuit 100-3, a drain end of the NMOSFET 120 is connected to a cathode end of the light emitting element 111, a source end is connected to a ground end VSS, and an anode end of the light emitting element 111 is connected to the driving voltage VDD end.

As described above, when the control circuit 120 is the NMOSFET, since a gate end of the NMOSFET becomes the input end 101 of the control circuit 120, and a drain end becomes the output end 102 of the control circuit 120, a drain end of the NMOSFET 130 is connected to the gate end 101 of the NMOSFET 120, a source end is connected to the drain end 102 of the NMOSFET 120, and the NMOSFET 130 is turned on/off according to the control signal CMP input to the gate end.

The NMOSFET 141 is turned on/off according to the scan signal SCAN(n) input to the gate end and transfers the reference signal Vref and the gradation data signal Vw input to the drain end to the input end 101 of the control circuit 120 through the first capacitor 142.

Meanwhile, since the transistors 120, 130, and 141 are all implemented as NMOSFETs in the pixel circuit 100-3 of FIG. 9, unlike the pixel circuit 100-1 in which the transistors 120, 130, and 141 are all implemented as PMOSFETs, all signals must be applied in an inverted form of the lower view of FIG. 4B, FIG. 5A, and FIG. 6. This is obvious to those skilled in the art, and thus a more detailed description thereof will be omitted.

Figure 10:
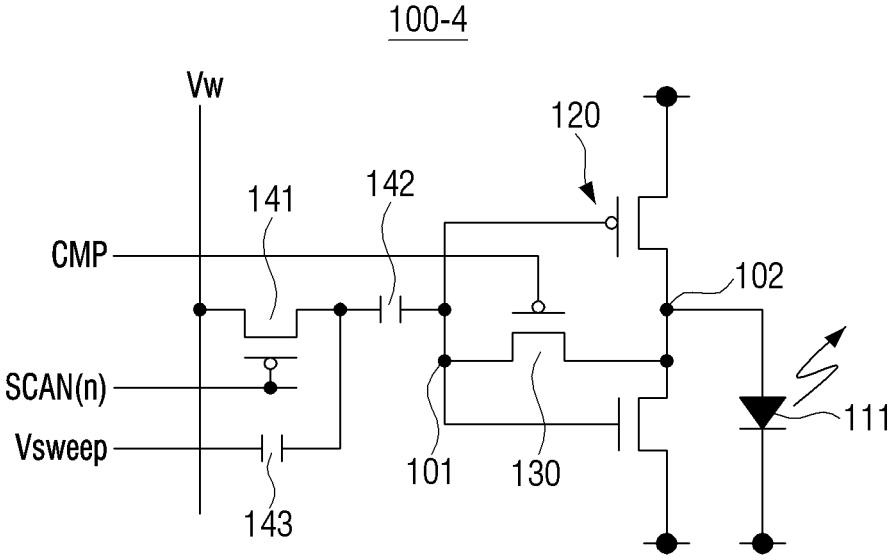

FIG. 10 shows an embodiment in which the control circuit 120 is implemented as a CMOSFET inverter. Referring to FIG. 10, it may be seen from a pixel circuit 100-4 that the control circuit 120 is implemented as the CMOSFET inverter, and the first switching element 130 is connected between the input end 101 of the CMOSFET inverter 120 and the output end 102 when viewed with respect to the pixel circuit 100-1 of FIG. 4B.

In this case, since the control circuit 120 is not implemented as a single transistor such as an NMOSFET or a PMOSET, a threshold voltage set to the input end of the control circuit 120 while the first switching element 130 and the second switching element 141 are turned on may not be the threshold voltage Vth of a specific transistor but, for example, a threshold voltage having the same magnitude as VDD/2 may be set. However, the disclosure is not limited thereto.

Meanwhile, FIGS. 8 to 10 illustrate an example where the light emitting unit 110 includes only the light emitting element 111 and the control circuit 120 is turned on/off according to a voltage of the input end 101 and directly controls the light emitting element 111 but the embodiment is not limited thereto.

Figure 11:
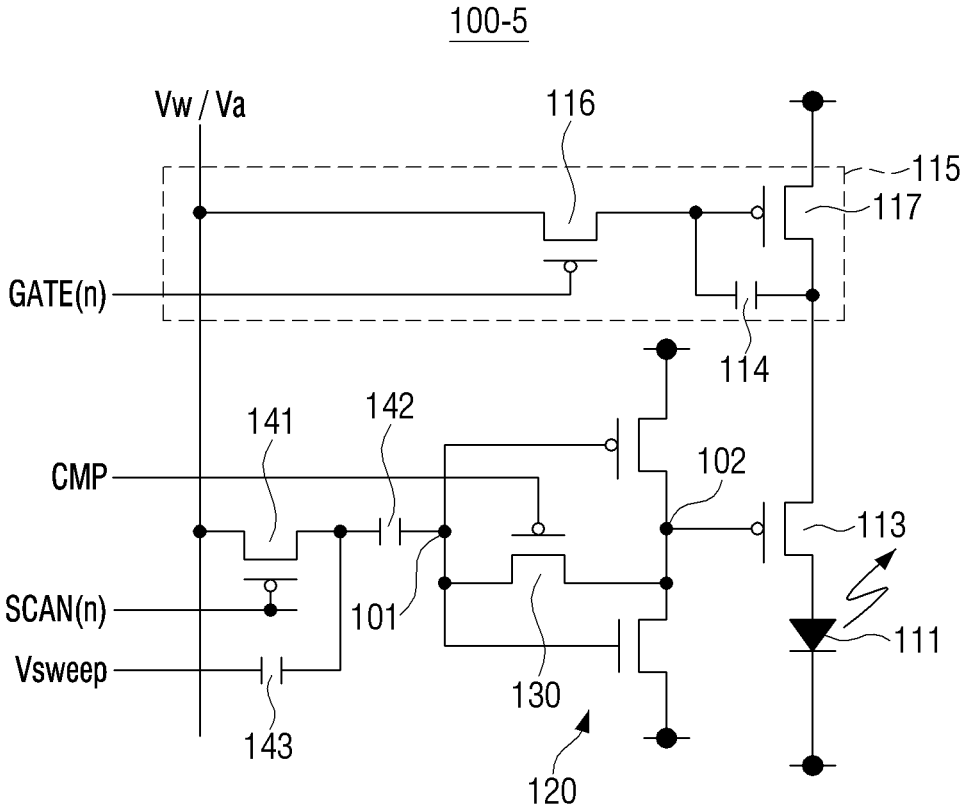

A pixel circuit 100-5 of FIG. 11 includes the current source 115 and includes the switching element 113 between the current source 115 and the light emitting element 111. Meanwhile, the control circuit 120 is implemented as a CMOSFET and the output end 102 of the control circuit 120 is connected to a gate end of the switching element 113. The control circuit 120 controls on/off of the switching element 113 according to a voltage of the input end 101 which changes according to a gradation data signal and a sweep signal, thereby controlling a light emitting duration of the light emitting element 111.

On the other hand, the current source 115 includes the driving transistor 117 and supplies a driving current of the corresponding amplitude to the light emitting element 111 according to the amplitude setting voltage Va of the driving current.

Figure 12:
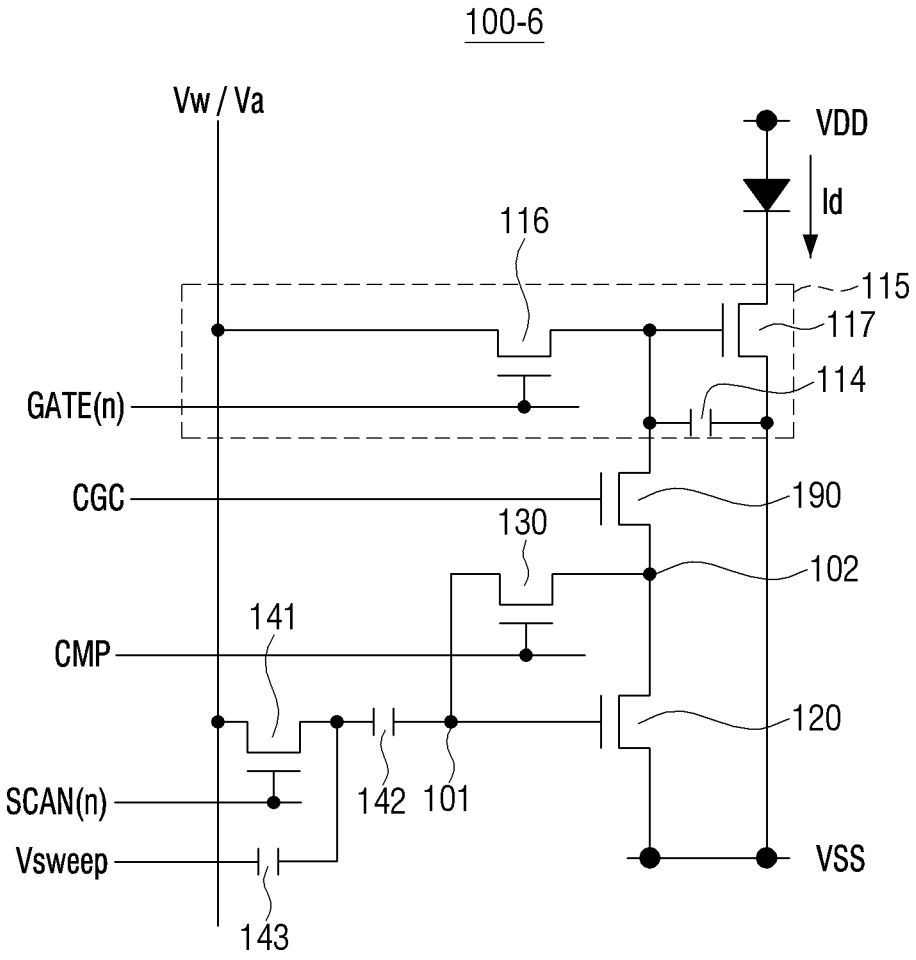

The pixel circuit 100-6 of FIG. 12 is an example in which the control circuit 120 controls a gate voltage of the driving transistor 117 included in the current source 115 to control a light emitting duration of the light emitting element 111. Since the control circuit 120 is implemented as an NMOSFET, an output end of the control circuit 120, that is, a drain end of the NMOSFET 120 is connected to a gate end of the driving transistor 117 of the current source 115.

Meanwhile, the current source 115 of the pixel circuit 100-6 may supply driving currents of different amplitudes according to a voltage applied to the gate end of the driving transistor 117. At this time, the current source 115 may include an amplitude setting circuit for setting the amplitude setting voltage Va to be applied to the gate end of the driving transistor 117. In the pixel circuit 100-6, the transistor 116 and the capacitor 114 constitute the amplitude setting circuit.

Figure 13A:
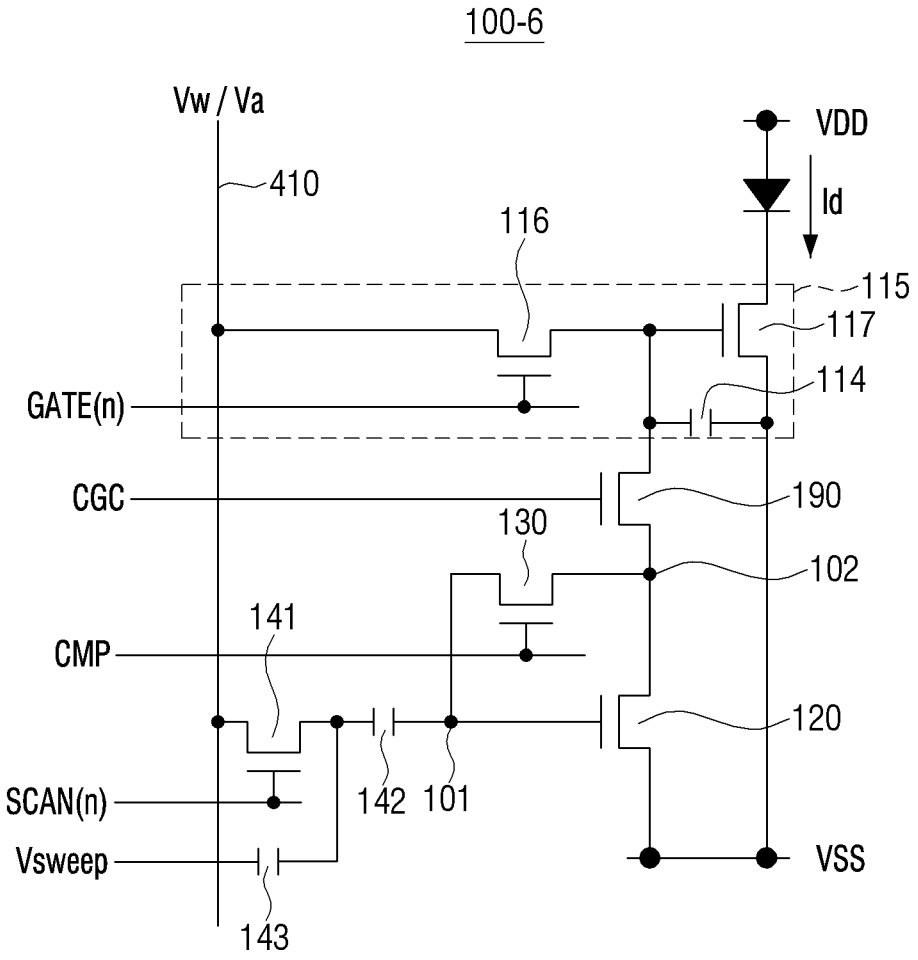

An operation of the pixel circuit 100-6 of FIG. 12 will be described in more detail with reference to FIGS. 13A and 13B. The pixel circuit 100-6 in FIG. 13A is the same circuit as the pixel circuit 100-6 in FIG. 12, and FIG. 13B is a timing diagram of various data signals and a control signal input to a display panel including the pixel circuits 100-6.

Figure 13B:
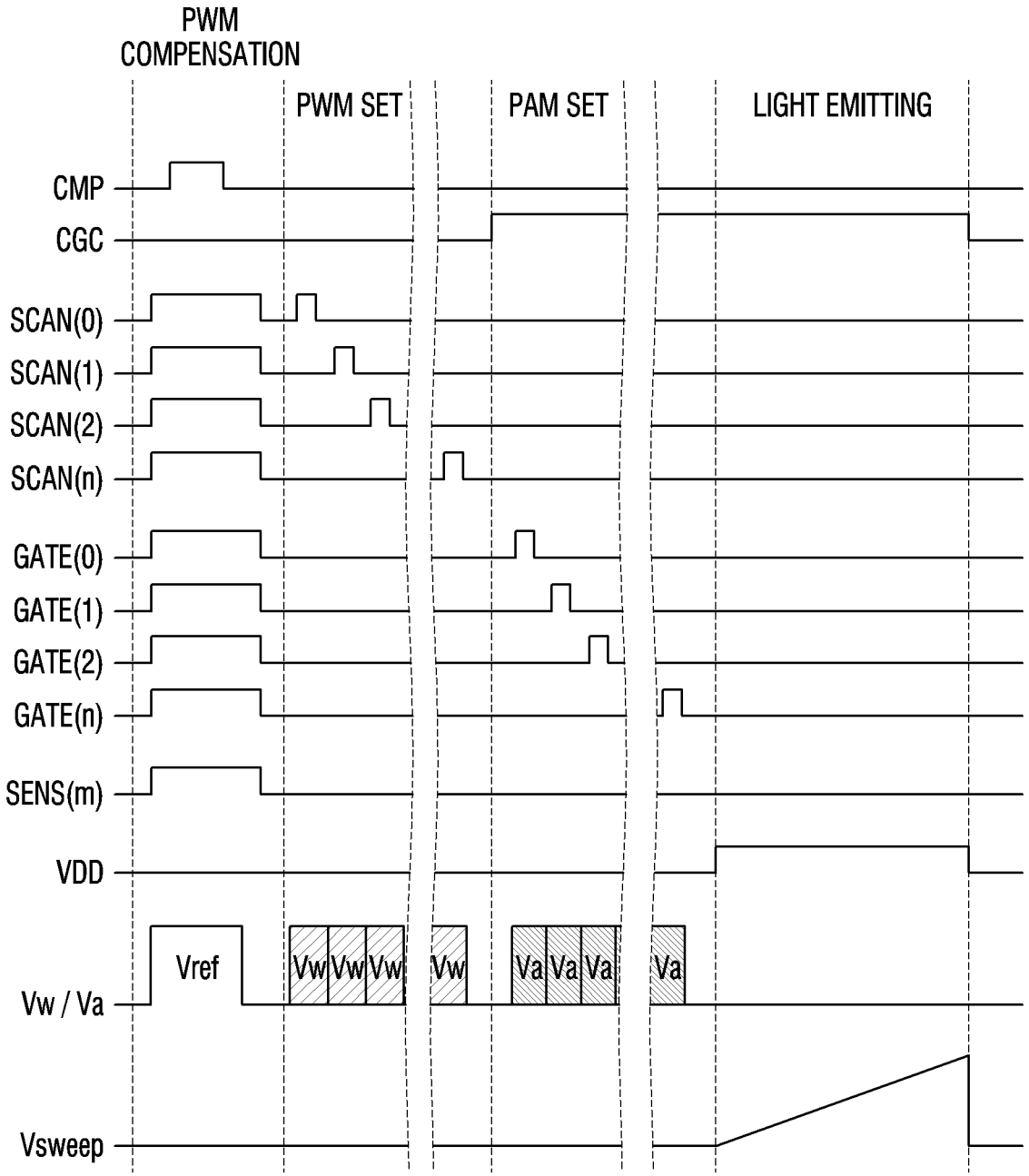

Referring to FIG. 13B, first, before a PWM correction period, the first switching element 130, the second switching element 141, and the third switching element 116 are turned on according to the control signals CMP, SCAN(n), and GATE(n) and a deviation correction between pixels is performed through the reference voltage Vref.

Thereafter, the pulse width setting voltage Vw is set in order to set a driving time (a duty ratio or a pulse width) of the driving current for driving the light emitting element 111 during a PWM (Pulse Width Modulation) set period, and the amplitude setting voltage Va is set in order to set amplitude of the driving current during a PAM (Pulse Amplitude Modulation) set period. That is, in the example of the pixel circuit 100-6, gradation data voltages representing the gradation of a pixel are two of the amplitude setting voltage Va and the pulse width setting voltage Vw.

Accordingly, when the light emitting period starts, the driving voltage VDD is applied to start emitting the light emitting element 111 with the driving current having the set amplitude. On the other hand, the light emitting element 111 emits light until the linearly increasing sweep voltage Vsweep reaches the threshold voltage Vth of the transistor 120 and thus the gate end voltage of the driving transistor 117 becomes the ground voltage VSS. At this time, the light emitting duration of the light emitting element 111 corresponds to the set pulse width setting voltage Vw.

In the pixel circuit 100-6, the transistor 190 is turned on/off according to the control signal CGC to electrically connect/disconnect the amplitude setting circuit and a circuit for setting the gradation data voltage Vw. In the case of the pixel circuit 100-6, as shown in FIG. 13B, the sweep voltage Vsweep may also be a voltage that increases linearly.

Figure 14A:
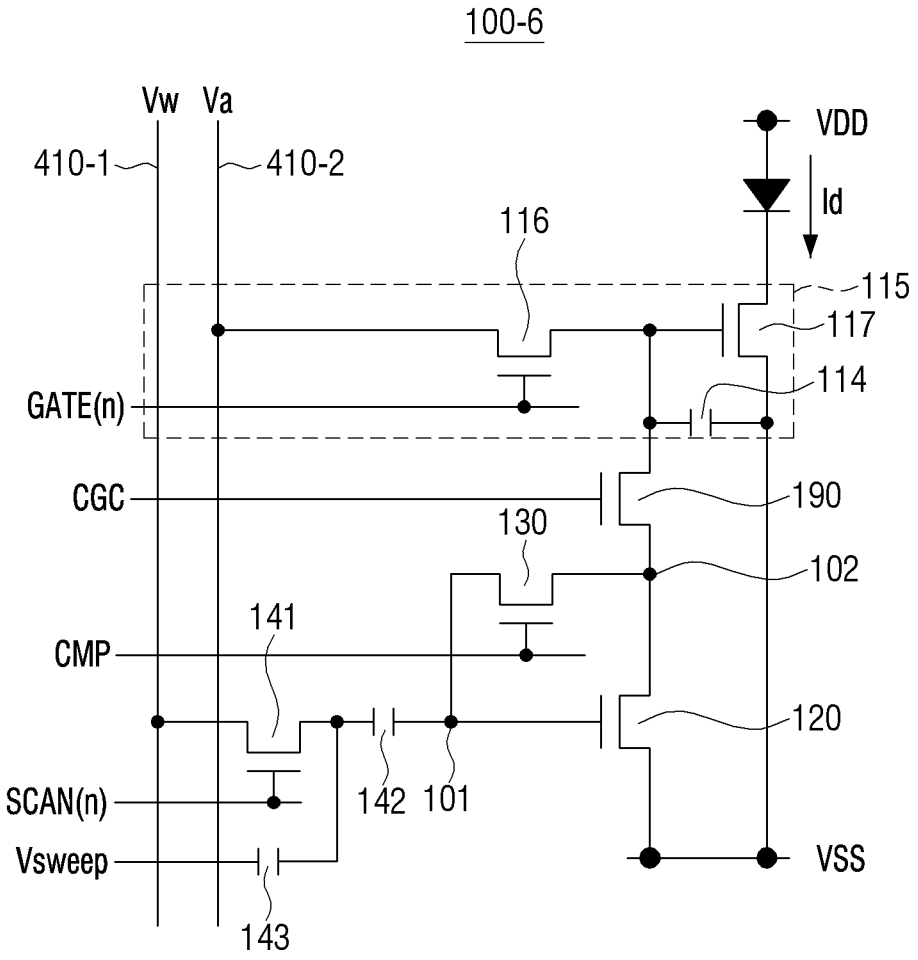
Figure 14B:
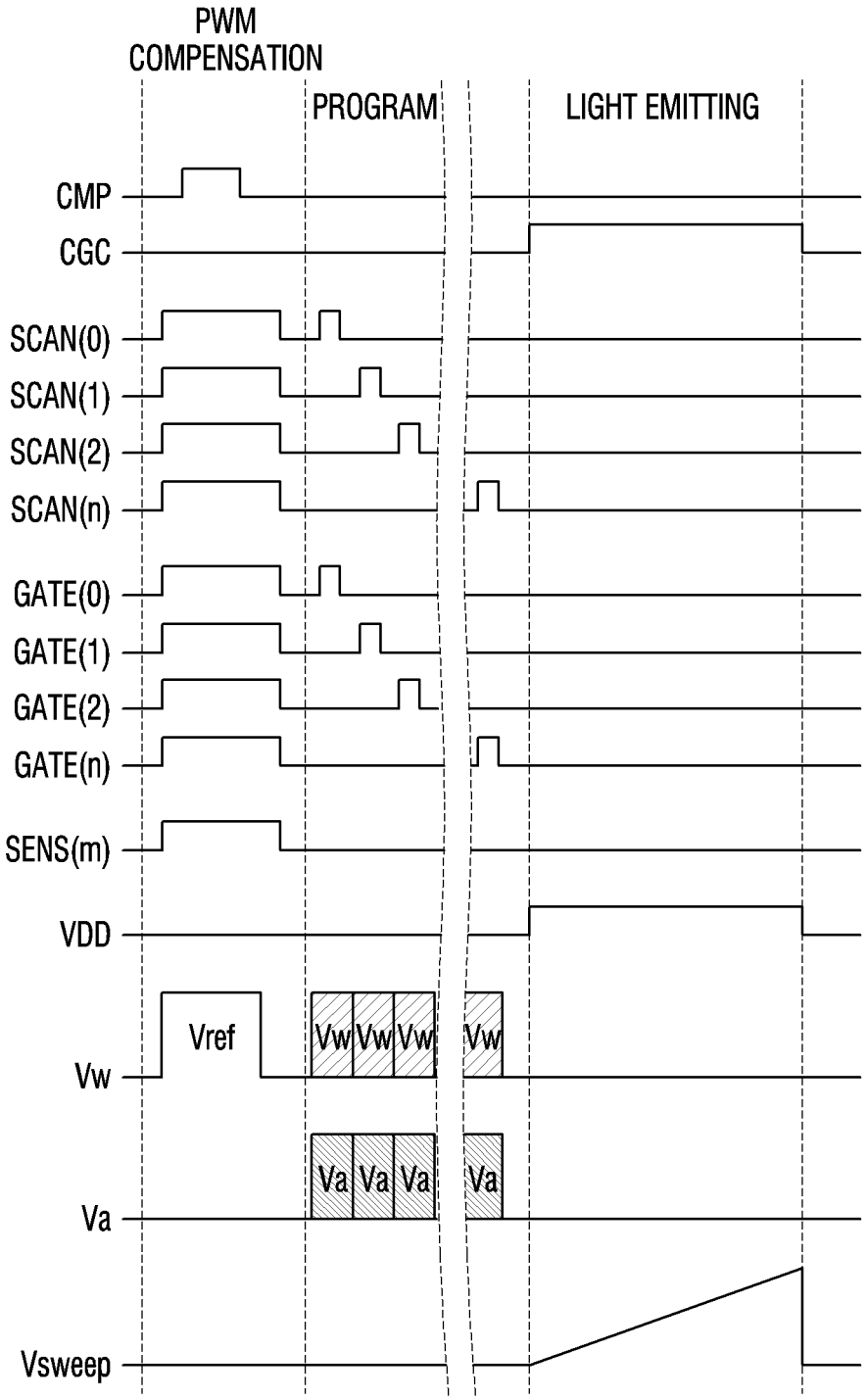

FIGS. 14A and 14B show another operation embodiment of the pixel circuit 100-6 of FIG. 12. As shown in FIG. 14A, the pixel circuit 100-6 has the same configuration as the pixel circuit 100-6 of FIG. 12 except that the amplitude setting voltage Va and the pulse width setting voltage Vw are applied to different data lines. Therefore, in the example of FIGS. 14A and 14B, the pixel circuit 100-6 may simultaneously set the amplitude setting voltage Va of the driving current and the pulse width setting voltage Vw together at the same time during a program period.

Meanwhile, FIGS. 12 to 14B illustrate an embodiment in which all the transistors included in the pixel circuit 100-6 are implemented as NMOSFETs, but all the transistors may be PMOSFETs to implement a pixel circuit. In this case, various control signals and data signals must be inverted and the sweep signal must be applied as a linearly decreasing type voltage.

FIGS. 15 to 17B show various embodiments in which a compensation circuit is applied to the pixel circuit 100-6.

Referring to FIG. 15, a pixel circuit 100-7 further includes a transistor 15 for current detection in addition to the pixel circuit 100-6. Meanwhile, the compensation circuit 1500 may include a correction unit 1510, a D/A converter 1520, a current detection unit 1530, and a switch 1540.

The transistor 15 is connected to a switch 1540 of the compensation circuit 1500 and is turned on according to the control signal SENS(n) input through a gate end such that the current detection unit 1030 may detect a current Id flowing through the driving transistor 117.

More specifically, before the pixel circuit 100-7 starts an amplitude setting and pulse width setting operation to display an image frame, the compensation circuit 1500 first supplies the specific voltage Vx through the D/A converter 1020 to the gate end of the driving transistor 117 and accordingly detects the current Id flowing through the driving transistor 117 through the current detecting unit 1530. (At this time, the transistor 15 is turned on according to the control signal SENS(n)).

The correction unit 1510 of the compensation circuit 1500 corrects the amplitude setting voltage Va using a current value detected through the current detection unit 1530 and then provides the corrected amplitude setting voltage Va to the D/A converter 1520 and the D/A converter 1520 applies the corrected amplitude setting voltage Va to the data signal line 410 in order.

The pixel circuit 100-7 performs the amplitude setting operation according to the corrected amplitude setting voltage Va as above.

More specifically, the correction unit 1510 may correct the input image data (in particular, the amplitude setting voltage Va) using the detection current value provided by the current detection unit 1530. For example, the correction unit 1510 may compare data about a current value to flow in the driving transistor 117 corresponding to the specific voltage Vx with the current value detected by the current detection unit 1530 to correct the amplitude setting voltage Va.

At this time, the data about the current value corresponding to the specific voltage Vx may be stored in various memories (not shown) inside or outside the compensation circuit 1500 in the form of a lookup table or the like. The correction unit 1510 may obtain and use the data stored in various memories (not shown). However, the example in which the correction unit 1510 corrects the image data using the detected current value is not limited thereto. To this end, the correction unit 1510 may be implemented as various processors, a FPGA (Field-Programmable Gate Array), and a timing controller (TCON), but the disclosure is not limited thereto.

The D/A converter 1520 may apply the image data or the amplitude setting voltage Va of the driving current Id corresponding to the image data corrected by the correction unit 1510 to the data signal line 410. The D/A converter 1520 may also apply the specific voltage Vx to the data signal line 410 for detecting the current flowing through the driving transistor 117 for image data correction. At this time, an operation of the D/A converter 1520 may be controlled by the correction unit 1510, but is not limited thereto, and may be controlled by an external processor.

The current detection unit 1530 may detect the current flowing in the driving transistor 117. To this end, the current detection unit 1530 may be implemented in various ways according to a current detection method. For example, when detecting a current by measuring a voltage applied to both ends of a resistor, the current detection unit 1530 may include the resistor. In the case of detecting the current by measuring a variation of a voltage applied to both ends of a capacitor, the current detection unit 1530 may be implemented by including an OP-AMP (Operational Amplifier) and the capacitor, but the disclosure is not limited thereto.

The switch 1540 switches between the D/A converter 1520 and the current detection unit 1530 according to the above-described operation order. To this end, the switch 1540 may be implemented as various transistors, but is not limited thereto.

Meanwhile, each of the components of the compensation circuit 1500 described above may be included in a source driver for driving the display panel, but the disclosure is not limited thereto. For example, in the case where an external processor executes an operation of the correction unit 1510, the D/A converter 1520 and the current detection unit 1530 may be included in the source driver and the correction unit 1510 may be implemented in the form of using the external processor.

Figure 16:
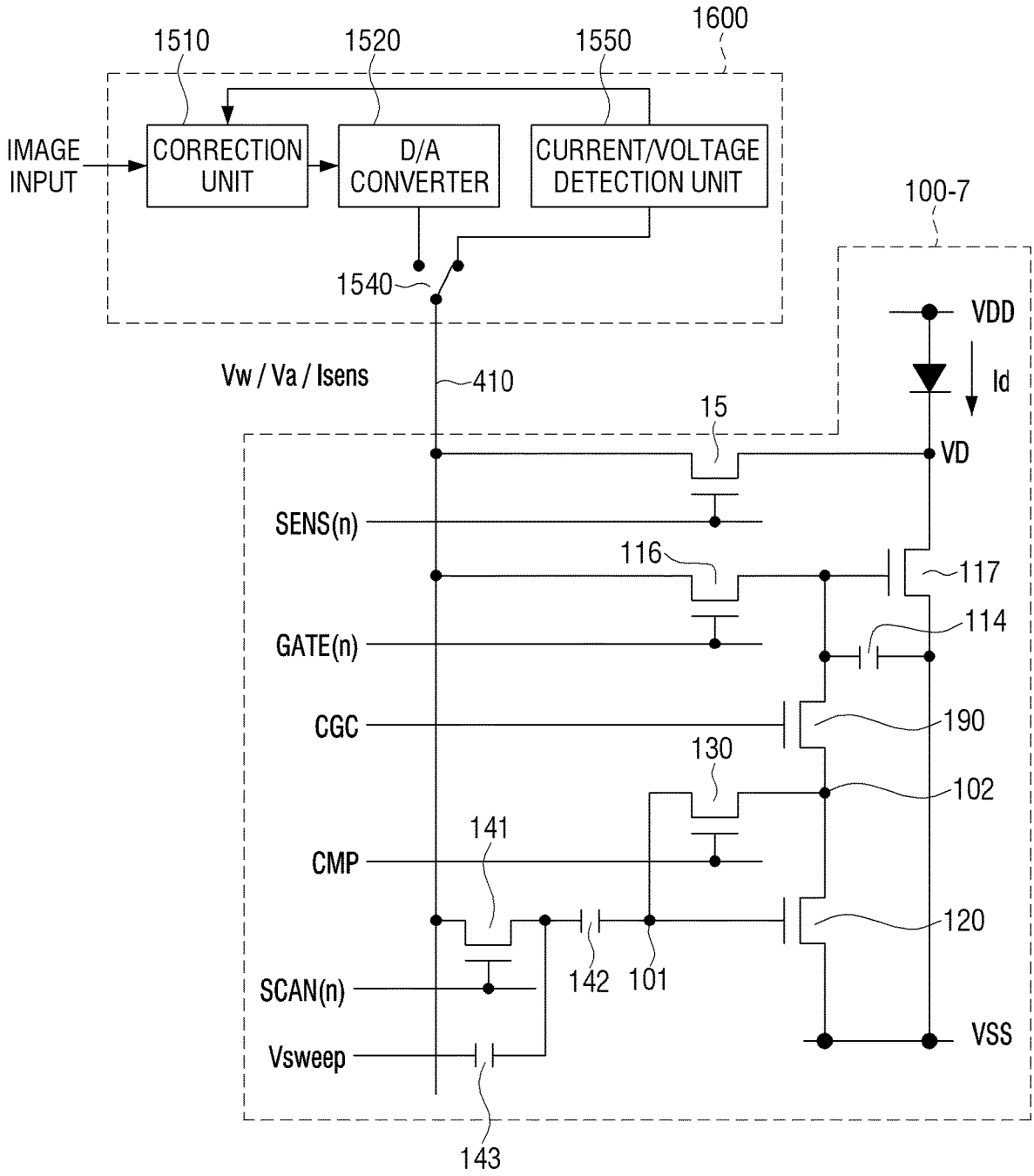

FIG. 16 is a diagram showing another embodiment in which a compensation circuit is applied to the pixel circuit 100-6. The pixel circuit 100-7 in FIG. 16 is the same as the pixel circuit 100-7 in FIG. 15. However, the compensation circuit 1600 of FIG. 16 includes a current/voltage detection unit 1550 instead of the current detection unit 1530 of the compensation circuit 1500 of FIG. 15.

The current/voltage detection unit 1550 in FIG. 16 may detect a drain end voltage Vd of the driving transistor 117 during the light emission of the light emitting element 111, in addition to detecting the driving current Id before the pixel circuit 100-7 operates as described above with reference to FIG. 15.

Accordingly, according to the embodiment of FIG. 16, in addition to correcting a deviation between the driving transistors 117 included in the current source by correcting the amplitude setting voltage Va using the driving current Id detected before the pixel circuit 100-7 operates, the amplitude setting voltage Va is corrected using the drain end voltage Vd of the driving transistor 117 detected during the light emission of the light emitting element 111, thereby correcting a deviation of the forward voltage Vf of the light emitting element 111.

Figure 17A:
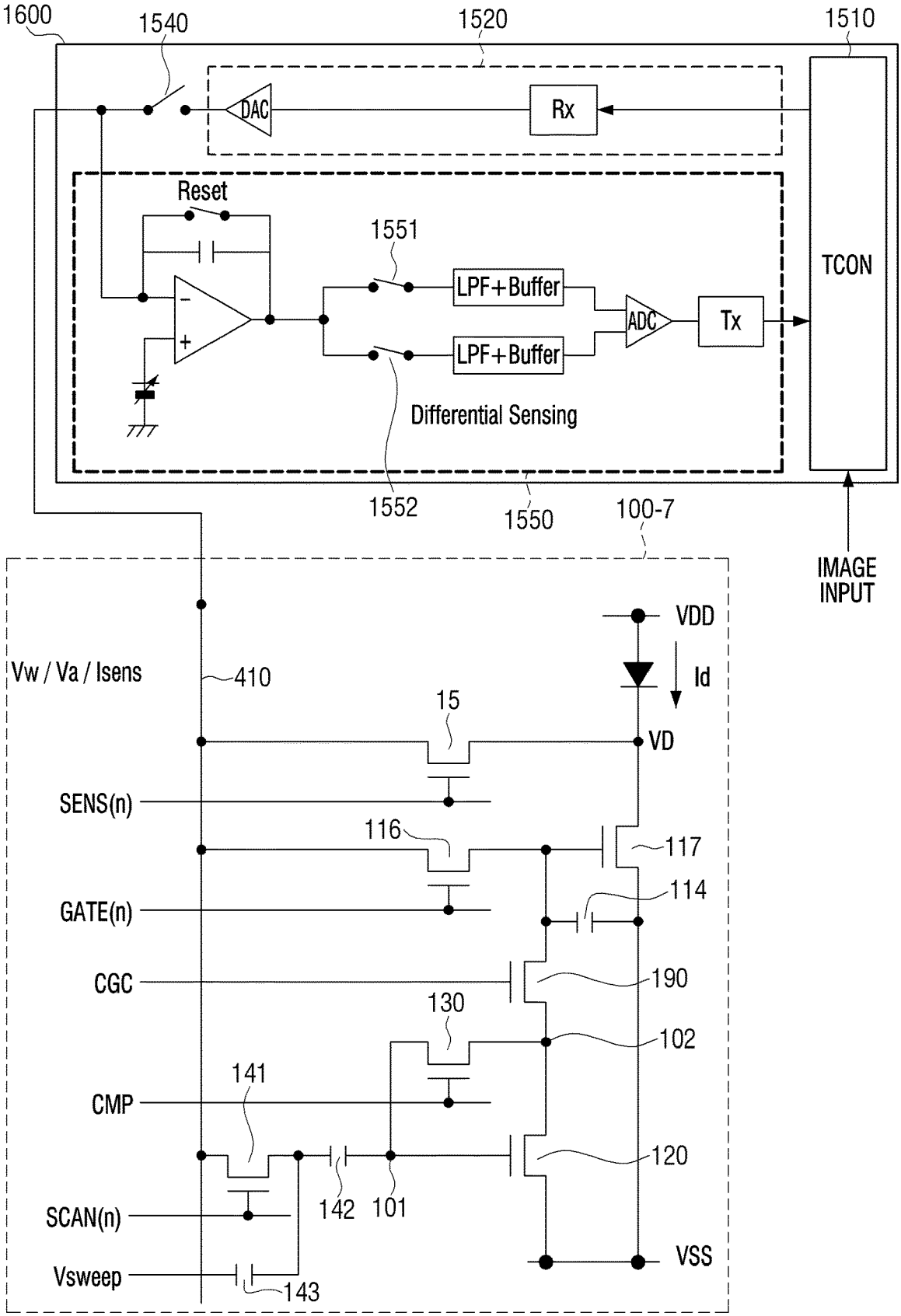

FIG. 17A shows a specific configuration of the compensation circuit 1600 of FIG. 16. Referring to FIG. 17A, it may be seen that the correction unit 1510 is implemented as a TCON and the current/voltage detection unit 1550 has a differential sensing structure. At this time, differential sensing operates by switching (for example, switch 1 1551/switch 2 1552 are turned on/off or off/on) of switch 1 1551 and switch 2 1552, and input data may be the same or different. At this time, scan lines sensing each of the case where no data exists and the case where data exists may be the same scan line or different scan lines.

Figure 17B:
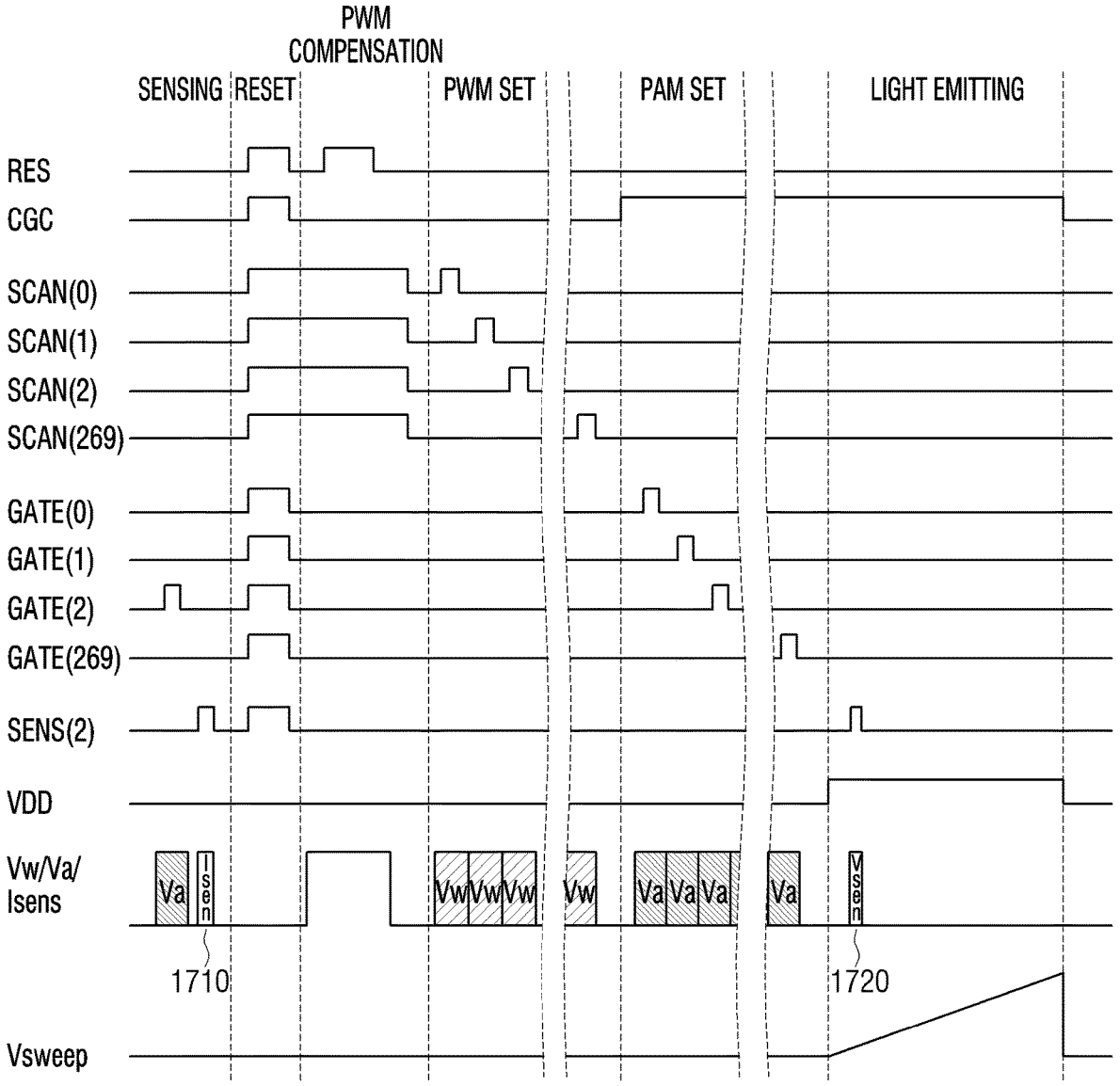

FIG. 17B is a timing diagram showing operations of the compensation circuit 1600 and the pixel circuit 100-7 of FIG. 17A. As shown in FIG. 17B, it may be seen that current sensing Isen is performed 1710 before the pixel circuit 100-7 operates, and voltage sensing Vsen is performed during the light emission 1720 of the light emitting element 111.

Figure 18:
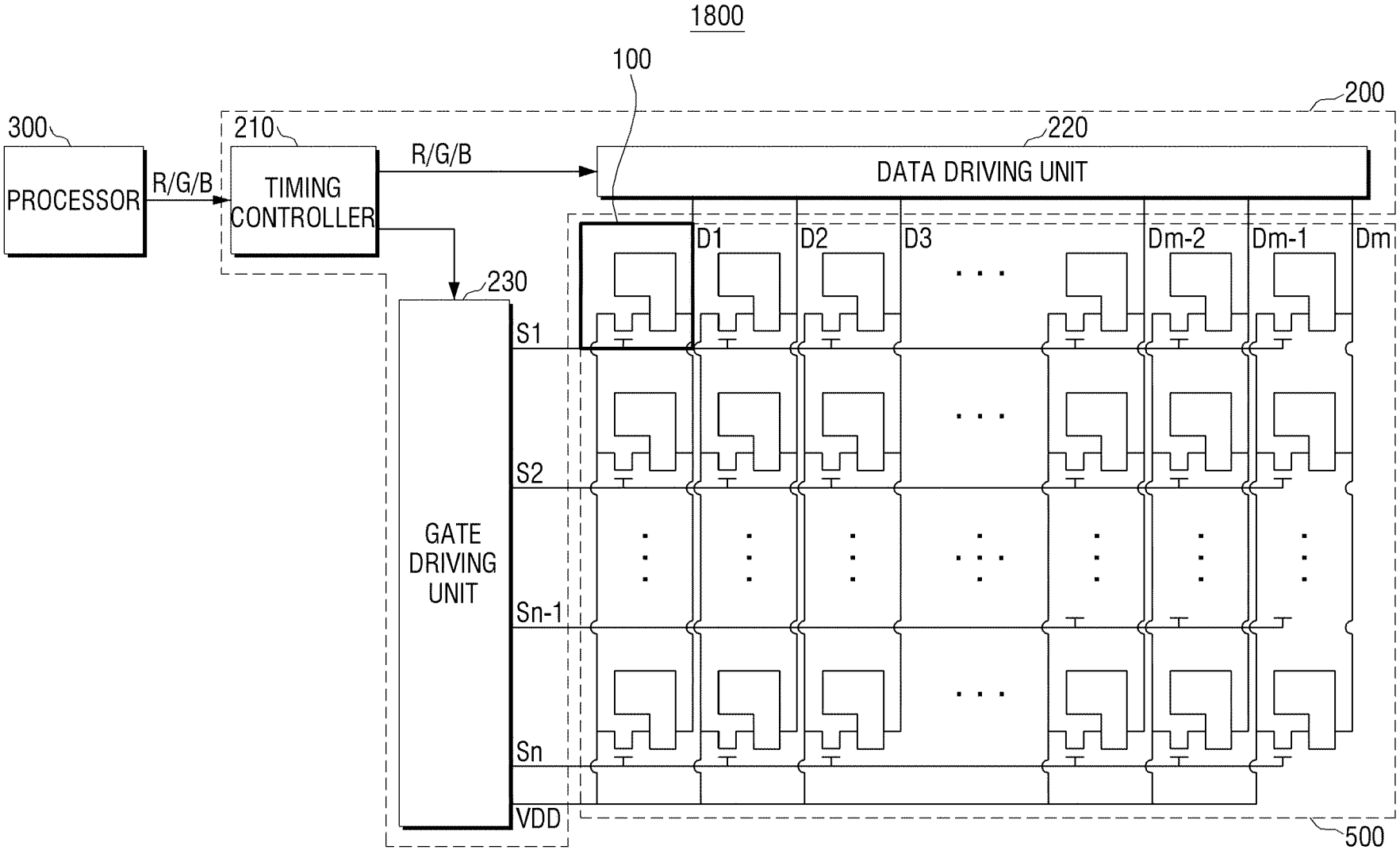
FIG. 18 is a configuration diagram of a display device according to an embodiment of the disclosure.

FIG. 18 is a configuration diagram of a display device 1800 according to an embodiment of the disclosure. Referring to FIG. 18, the display device 1800 includes the display panel 500, a panel driver 200, and a processor 300.

The display panel 500 includes the plurality of pixel circuits 100. Here, the pixel circuits 100 may be any of the above-described pixel circuits 100-1 to 100-7.

Specifically, the display panel 500 may be formed such that scan lines 51 to Sn and data lines D1 to Dm intersect with each other, and the pixel circuits 100 may be formed in regions formed by such intersections. For example, each of the plurality of pixel circuits 100 may be configured such that adjacent R, G, and B sub-pixels form one pixel, but the disclosure is not limited thereto.

Meanwhile, for convenience of illustration in FIG. 18, the scan signal lines 51 to Sn each for applying a control signal to each of the pixel circuits 100 included in the display panel 500 in the gate driver 230 and only one data signal lines D1 to Dm each for applying a data signal to each of the pixel circuits 100 in the data driving unit 220 are illustrated, but according to the embodiment of the various pixel circuits described above, other data signal lines or control signal lines may be further included.

The panel driver 200 drives the display panel 500, more specifically, each of the plurality of the pixel circuits 100 under control of the processor 300 and may include a timing controller 210, a data driving unit 220, and a gate driving unit 230.

The timing controller 210 receives an input signal IS, a horizontal synchronizing signal Hsync, a vertical synchronizing signal Vsync, a main clock signal MCLK and the like from the outside to generate and provide an image data signal, a scanning control signal, a data control signal, a light emitting control signal and the like to the display panel 500, the data driving unit 220, and the gate driving unit 230, and the like.

The data driving unit 220 (or a source driver) is a means for generating a data signal, and receives image data of an R/G/B component from the processor 300 to generate the data signal. Also, the data driving unit 220 may apply generated various data signals to the display panel 500.

In particular, although not specifically shown in FIG. 18, the data driving unit 220 may apply an amplitude setting voltage and a pulse width setting voltage for setting the amplitude and the pulse width of the driving current Id, the linearity change voltages Va, Vw, and Vsweep, and the specific voltage Vx applied to each of the pixel circuits 100 to a gate end of the driving transistor 117 for detecting the current flowing in the driving transistor 117 according to various embodiments of the disclosure.

The gate driving unit 230 (or a gate driver) is means for generating various control signals such as the scan signal SCAN(n), the gate signal GATE(n) and the detection signal SENS(n), and the like and transfers the generated various control signals to a specific row of the display panel 500. The gate driving unit 230 may apply the driving voltage VDD to a driving voltage end of the pixel circuit 100 according to an embodiment.

On the other hand, the panel driving unit 200 may control brightness of light emitting portion 110, that is, an LED element, using at least one of the pulse width modulation PWM in which a duty ratio of the driving current Id varies and the amplitude modulation PAM in which the amplitude of the driving current Id varies under control of the processor 300. Here, an LED is described as a concept including an OLED. Also, the PWM signal controls a ratio of lighting-on and lighting-off of light sources, and a duty ratio (%) thereof may be determined according to a dimming value input from the processor 300.

The panel driving unit 200 may be implemented as a plurality of LED driving modules. In some cases, each of the plurality of LED driving modules may be implemented to include a sub-processor for controlling an operation of each pixel circuit 100 and a driving module for driving each display module under control of the sub-processor. In this case, each sub-processor and the driving module may be implemented as hardware, software, firmware, or an IC (integrated chip), etc. According to an embodiment, each sub-processor may be implemented as a separate semiconductor IC.

On the other hand, each of the plurality of LED driving modules may include at least one LED driver for controlling current applied to the LED element. The LED driver may be provided in each of a plurality of LED regions including a plurality of LED elements. Here, the LED region may be a smaller than the LED module described above. For example, one LED module may be divided into a plurality of LED regions including a predetermined number of LED elements, and each of the plurality of LED regions may include the LED driver. In this case, the current control may be possible for each region. However, the disclosure is not limited thereto, and the LED driver may be provided in an LED module unit.

According to an embodiment, the LED driver may be placed at the rear end of a power supply to receive voltage from the power supply. However, according to another embodiment, a voltage may be supplied from a separate power supply device. Alternatively, it is also possible that an SMPS and the LED driver are implemented as a single integrated module.

The LED driver according to various embodiments of the disclosure may use both the PAM and the PWM method that may be used to represent various gradations of an image.

The processor 300 controls the overall operation of the display device 1800 and, in particular, drives the display panel 500 by controlling the panel driving unit 200 to perform operations of the various pixel circuits 100-1 to 100-2 described above. To this end, the processor 300 may be implemented as one or more of a central processing unit (CPU), a micro-controller, an application processor (AP), a communication processor (CP), and an ARM processor.

Specifically, according to an embodiment of the disclosure, the processor 300 may control the panel driver 200 such that the pulse width of the driving current Id is set according to the pulse width setting voltage Vw and the amplitude of the driving current Id is set according to the amplitude setting voltage Va. At this time, when the display panel 500 is composed of n rows and m columns, the processor 300 may control the panel driving unit 200 such that the amplitude or the pulse width of the driving current Id is set in a row unit.

Thereafter, the processor 300 may control the panel driving unit 200 such that the driving voltage VDD is simultaneously applied to the current sources 120 of the plurality of pixel circuits 100 included in the display panel 500 and the linear change voltage Vsweep is applied to the pulse width control circuit 140 of each of the plurality of pixel circuits 100, thereby displaying the image.

At this time, an operation of the processor 300 controlling the panel driver 200 to control an operation of each pixel circuit 100 included in the display panel 500 is the same as described above with reference to FIGS. 3 through 17B, and thus a redundant description thereof will be omitted.

Figure 19:
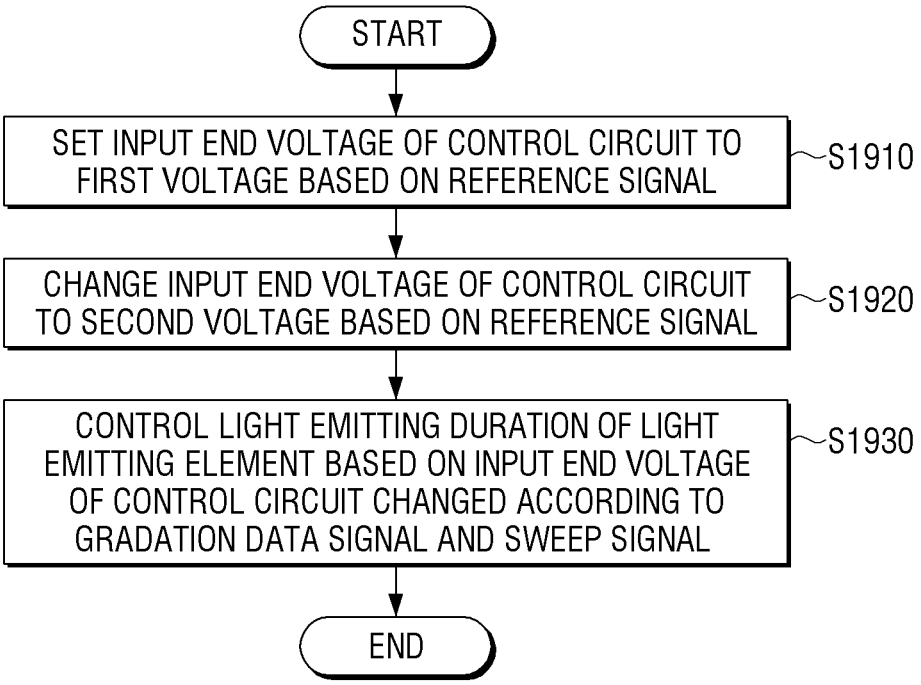
FIG. 19 is a flowchart showing a method of driving a display panel including a plurality of pixel circuits according to an embodiment of the disclosure.

FIG. 19 is a flowchart showing a method of driving a display panel including a plurality of pixel circuits according to an embodiment of the disclosure. At this time, each of the plurality of pixel circuits may include a light emitting unit including a light emitting element, a control circuit controlling a light emitting duration of a light emitting element based on an input end voltage, a first switching element and a second switching element connected between an input end and an output end of the control circuit, and a signal input unit transmitting an input signal to an input end of the control circuit.

More specifically, the display panel 500 may turn on the first switching element 130 and the second switching element 141 and set a voltage of the input end 101 of the control circuit 120 to a first voltage based on a reference signal input through the second switching element 141 (S1910).

The display panel 500 may turn off the first switching element 130 and the second switching element 141 after the voltage of the input end 101 of the control circuit 120 is set to the first voltage and change the voltage of the input end 101 of the control circuit 120 from the first voltage to a second voltage based on the reference signal (S1920).

Accordingly, when the voltage of the input end 101 of the control circuit 120 is changed to the second voltage and then a gradation data signal and a sweep signal are input through the signal input unit 110, the display panel 500 may control the light emitting duration of the light emitting element 111 based on the voltage of the input end 101 of the control circuit 120 that is changed according to the gradation data signal and the sweep signal (S1930).

At this time, first switching elements of each of the plurality of pixel circuits may be turned on/off simultaneously.

Meanwhile, a type of the light emitting element 111 included in the pixel circuit 100 may be an LED or an OLED, but is not limited thereto. Also, the pixel circuit 100 may be composed of a TFT. At this time, a channel material of the TFT may be an oxide or an organic material.

Also, according to an embodiment of the disclosure, a transistor constituting the pixel circuit 100 may be composed of only an NMOSFET, or may be composed of only a PMOSFET. However, the disclosure is not limited thereto, and the pixel circuit 100 including the CMOSFET may be implemented.

Also, according to an embodiment of the disclosure, when the data signal line 410 is one, pulse width and amplitude setting must be made at different time, but according to another embodiment, when the data signal lines 410-1 and 410-2 are two, the pulse width setting and the amplitude setting of a driving current may be performed simultaneously.

On the other hand, the amplitude setting of the driving current may be performed in a voltage programming method, but may be performed in a current programming method according to the embodiment. According to an embodiment, when the display panel 500 is configured by applying the compensation circuits 1500 and 1600 to the pixel circuit 100, the display device 1800 may set the amplitude of the driving current Id using the corrected amplitude setting voltage Va through the compensation circuits 1500 and 1600, and thus a deviation between TFTs and a deviation of the forward voltage Vf of the light emitting element may be reduced, thereby increasing brightness uniformity.

Meanwhile, the operation of the pixel circuit 100 and the driving method of the display panel 500 according to various embodiments described above may be generated in software and mounted on a display device.

For example, a non-transitory computer readable medium thereon storing a program performing a driving method of a display panel including setting an input end voltage of a control circuit to a first voltage based on a reference signal input through a second switching element by turning on a first switching element and the second switching element, after setting the input end voltage of the control circuit to the first voltage, changing the input end voltage of the control circuit from the first voltage to a second voltage based on a reference signal by turning off the first and second switching elements, and, after setting the input end voltage of the control circuit to the second voltage, when a gradation data signal and a sweep signal are input through a signal input unit, controlling a light emitting duration of a light emitting element based on the input end voltage of the control circuit which is changed according to the gradation data signal and the sweep signal may be installed.

In this regard, the non-transitory computer readable medium is not a medium that stores data therein for a while, such as a register, a cache, a memory, or the like, but means a medium that semi-permanently stores data therein and is readable by a device. In detail, various middleware or programs described above may be stored and provided in the non-transitory computer readable medium such as a compact disk (CD), a digital versatile disk (DVD), a hard disk, a Blu-ray disk, a universal serial bus (USB), a memory card, a read only memory (ROM), or the like.

As described above, according to various embodiments of the disclosure, the brightness uniformity and the light emitting efficiency of the display panel may be simultaneously improved.

Although the embodiments of the disclosure have been illustrated and described hereinabove, the disclosure is not limited to the abovementioned specific embodiments, but may be variously modified by those skilled in the art to which the disclosure pertains without departing from the scope and spirit of the disclosure as disclosed in the accompanying claims. These modifications should also be understood to fall within the scope of the disclosure.

What is claimed is:

1. A display panel comprising a plurality of pixel circuits, wherein each of the plurality of pixel circuits comprises:

a light emitting unit comprising a light emitting element;

a control circuit comprising an input end and an output end, the control circuit being configured to control a light emitting duration of the light emitting element based on a voltage of the input end;

a first switching element connected between the input end and the output end of the control circuit; and a signal input unit comprising a second switching element and configured to transmit an input signal to the input end of the control circuit, the input signal comprising a reference signal, a gradation data signal and a sweep signal, wherein the first switching elements of each of the plurality of pixel circuits are configured to turn on or off at once, wherein the voltage of the input end of the control circuit is set to a first value based on the reference signal input through the signal input unit while the first and second switching elements are turned on, and changed from the first value to a second value in response to the first and second switching elements being turned off, wherein, after the voltage of the input end of the control circuit is changed to the second value, the control circuit is further configured to control the light emitting duration based on the voltage of the input end of the control circuit being changed in time based on the gradation data signal and the sweep signal input through the signal input unit, and wherein a voltage value of the sweep signal is changed in time continuously.

2. The display panel as claimed in claim 1, wherein the signal input unit comprises:

a first capacitor having one end connected to the input end of the control circuit and another end connected to one end of the second switching element; and a second capacitor having the one end connected to the one end or the other end of the first capacitor and another end receiving the sweep signal, wherein the signal input unit is configured to transfer the reference signal and the gradation data signal input through the other end of the second switching element to the input end of the control circuit through the first capacitor while the second switching element is turned on.

3. The display panel as claimed in claim 2, wherein the input end voltage of the control circuit is set to a third voltage based on the gradation data signal input through the second switching element while the second switching element is turned on after being changed to the second voltage, and is changed according to the sweep signal input through the second capacitor after being set to the third voltage, and wherein the control circuit is further configured to control the light emitting duration by turning on or off the light emitting element based on the input end voltage changed according to the sweep signal.

4. The display panel as claimed in claim 2, wherein when the one end of the second capacitor is connected to the other end of the first capacitor, a magnitude of the reference signal and the gradation data signal is smaller than when the one end of the second capacitor is connected to the one end of the first capacitor.

5. The display panel as claimed in claim 2, wherein each of the second switching elements of the plurality of pixel circuits is configured to:

turn on together while the first switching element is turned on, transfer the reference signal to the input end of the control circuit of each of the plurality of pixel circuits, sequentially turn on after the input end voltage of the control circuit is changed to the second voltage, and transfer a gradation data signal for each of the plurality of pixel circuits to the input end of the control circuit of each of the plurality of pixel circuits.

6. The display panel as claimed in claim 1, wherein the control circuit is any one of a PMOSFET (P-channel metal oxide semiconductor field effect transistor), an NMOSFET (N-channel Metal Oxide Semiconductor Field Effect Transistor), and a CMOSFET (Complementary Metal Oxide Semiconductor Field Effect Transistor) inverter, and wherein the first and second switching elements are PMOSFETs or NMOSFETs.

7. The display panel as claimed in claim 6, wherein when the control circuit is the PMOSFET or the NMOSFET, a gate end of the PMOSFET or the NMOSFET is the input end of the control circuit, and a drain end of the PMOSFET or the NMOSFET is an output end of the control circuit, and wherein when the control circuit is the CMOSFET inverter, an input end of the CMOSFET inverter is the input end of the control circuit, and the output end of the CMOSFET inverter is the output end of the control circuit.

8. The display panel as claimed in claim 7, wherein when the control circuit is the PMOSFET, the drain end of the PMOSFET is connected to an anode end of the light emitting element having a cathode end connected to a ground end, and a source end of the PMOSFET is connected to a driving voltage end, and wherein the PMOSFET is configured to turn on or off according to a gate end voltage of the PMOSFET, which is changed based on the gradation data signal and the sweep signal to control the light emitting duration.

9. The display panel as claimed in claim 7, wherein when the control circuit is the NMOSFET, the drain end of the NMOSFET is connected to a cathode end of the light emitting element having an anode end connected to a driving voltage end, and a source end of the NMOSFET is connected to a ground end, and wherein the NMOSFET is configured to turn on or off according to a gate end voltage of the NMOSFET, which is changed based on the gradation data signal and the sweep signal to control the light emitting time of the light emitting element.

10. The display panel as claimed in claim 7, wherein when the control circuit is the CMOSFET inverter, an output end of the CMOSFET inverter is connected to an anode end of the light emitting element having a cathode end connected to a ground end, and wherein the CMOSFET inverter is configured to turn on or off according to an input end voltage of an inverter of the CMOSFET, which is changed based on the gradation data signal and the sweep signal to control the light emitting duration of the light emitting element.

11. The display panel as claimed in claim 1, wherein the light emitting unit further comprises a current source configured to supply a driving current to the light emitting element, and a third switching element connected between the current source and the light emitting element, and wherein the control circuit is further configured to control the light emitting duration by turning on or off the third switching element according to the input end voltage, which is changed based on the gradation data signal and the sweep signal.

12. The display panel as claimed in claim 1, wherein the light emitting unit further comprises a current source configured to supply a driving current to the light emitting element, and wherein the control circuit is further configured to control the light emitting duration by controlling a gate end voltage of a driving transistor included in the current source according to the input end voltage, which is changed based on the gradation data signal and the sweep signal.

13. The display panel as claimed in claim 1, wherein the light emitting unit further comprises a driving transistor and a current source configured to supply a driving current having a different amplitude to the light emitting element according to a magnitude of a voltage applied to a gate end of the driving transistor, and wherein the current source comprises an amplitude setting circuit configured to apply voltages of different magnitudes to the gate end of the driving transistor.

14. The display panel as claimed in claim 1, wherein the light emitting element is a light emitting diode (LED) or an organic light emitting diode (OLED).

15. A driving method of a display panel comprising a plurality of pixel circuits, in which each of the plurality of pixel circuits comprises:

a light emitting unit comprising a light emitting element;

a control circuit comprising an input end and an output end, the control circuit being configured to control a light emitting duration of the light emitting element based on a voltage of the input end;

a first switching element connected between the input end and the output end of the control circuit; and a signal input unit comprising a second switching element and configured to transmit an input signal to the input end of the control circuit, the input signal comprising a reference signal, a gradation data signal and a sweep signal, the driving method comprising:

setting the voltage of the input end of the control circuit to a first value based on the reference signal input through the signal input unit while turning on the first and second switching elements;

changing the voltage of the input end of the control circuit from the first value to a second value in response to the first and second switching elements being turned off; and after changing the voltage of the input end of the control circuit to the second value, controlling the light emitting duration based on the voltage of the input end of the control circuit being changed in time based on the gradation data signal and the sweep signal input through the signal input unit, wherein the first switching elements of each of the plurality of pixel circuits are configured to turn on or off at once, and wherein a voltage value of the sweep signal is changed in time continuously.

* * * * *